US008851064B2

(12) United States Patent
Bruckbauer

(10) Patent No.: US 8,851,064 B2
(45) Date of Patent: Oct. 7, 2014

(54) DEVICE FOR REMOVING COOKING VAPORS COMPRISING A FLAT EXHAUST AIR DUCT

(76) Inventor: Wilhelm Bruckbauer, Neubeuern (DE)

( * ) Notice: Subject to any disclaimer, the term of this patent is extended or adjusted under 35 U.S.C. 154(b) by 1198 days.

(21) Appl. No.: 12/522,633

(22) PCT Filed: Jan. 3, 2008

(86) PCT No.: PCT/DE2008/000003

§ 371 (c)(1),
(2), (4) Date: Jul. 9, 2009

(87) PCT Pub. No.: WO2008/083660

PCT Pub. Date: Jul. 17, 2008

(65) Prior Publication Data

US 2010/0116263 A1 May 13, 2010

(30) Foreign Application Priority Data

Jan. 10, 2007 (DE) ..... 20 2007 000 610 U
Nov. 20, 2007 (EP) ..... 07022454
Dec. 12, 2007 (DE) ..... 20 2007 017 325 U

(51) Int. Cl.
*F24C 15/20* (2006.01)

(52) U.S. Cl.
CPC ..... *F24C 15/2042* (2013.01); *F24C 15/2071* (2013.01)
USPC ..... 126/299 D

(58) Field of Classification Search
USPC ..... 126/299 D, 299 R, 299 E, 299 F, 381.1, 126/385.1, 76, 58, 287, 285 R; 454/237, 454/188, 265–267, 363, 361, 49, 5, 58; 55/DIG. 36; 49/40; 251/301
See application file for complete search history.

(56) References Cited

U.S. PATENT DOCUMENTS

| | | | | | |
|---|---|---|---|---|---|
| 1,322,711 | A | * | 11/1919 | Maranville | 454/363 |
| 3,002,513 | A | | 10/1961 | Morasch | |
| 3,400,649 | A | * | 9/1968 | Jensen | 126/299 D |
| 3,444,805 | A | * | 5/1969 | Mitter et al. | 99/340 |
| 3,587,555 | A | * | 6/1971 | Cerola | 126/11 |
| 3,756,217 | A | * | 9/1973 | Field | 126/37 R |
| 3,766,906 | A | * | 10/1973 | Jenn | 126/299 R |
| 3,889,581 | A | * | 6/1975 | Bray, Sr. | 126/299 E |
| 4,562,827 | A | * | 1/1986 | Cerola | 126/299 R |

(Continued)

FOREIGN PATENT DOCUMENTS

DE 20 2007 000610 4/2007

*Primary Examiner* — Avinash Savani
*Assistant Examiner* — Vivek Shirsat
(74) *Attorney, Agent, or Firm* — Douglas E. Jackson; Stites & Harbison PLLC

(57) ABSTRACT

A device for removing cooking vapors in a direction vertically below a hob plane includes a cooking vapor entry device that can be reversibly opened and closed and an exhaust air duct that is connected thereto. A connecting section is provided downstream on the cooking vapor entry device. The downstream exit opening of the connecting section has the cross-section of a horizontally extending rectangle, an oblong hole or a slot, with the width of the exit opening being larger than the height thereof and the width corresponding approximately to the width of the entry opening. One or more flat duct elements having respective horizontally extending, rectangular cross-sections are connected to the cooking vapor entry device and/or to the preliminary section and/or to the connecting section either indirectly or directly, downstream of the exit opening from the side and horizontally and/or from the side and from below at an angle.

14 Claims, 20 Drawing Sheets

(56) References Cited

U.S. PATENT DOCUMENTS 4,934,337 A 6/1990 Falk
5,139,048 A * 8/1992 Armstrong ..... 137/553
2006/0278215 A1 12/2006 Gagas et al.
2007/0062513 A1 * 3/2007 Gagas ..... 126/299 D

* cited by examiner

DEVICE FOR REMOVING COOKING VAPORS COMPRISING A FLAT EXHAUST AIR DUCT

The present invention relates to a device for removing cooking vapors in a direction vertically below a hob plane comprising a particularly streamlined exhaust air duct with a low level of flow resistance and with a very small spatial requirement.

A suction device for cooking vapors is revealed from U.S. Pat. No. 3,002,513, in which a suction device enclosing a hob in a hemi-spherical manner from below is intended to draw cooking vapors vertically downwards from cooking pots positioned on the hob. This known suction device comprises a first plate-shaped wall extending below the hob, and a second plate-shaped wall spaced apart therefrom, forming a gap and extending below the hob, the cooking vapors being drawn downward through the hemi-spherical gap between the first wall and the second wall and being supplied to a suction pipe connected to the second wall from the side at an angle.

This device is disadvantageous, in particular, as it merely draws in cooking vapors rising from the edge region of the cooking pots, but not the cooking vapors rising from the central region of the cooking pots.

A further drawback of this device may be seen to be that considerable turbulence occurs here in the region of the lateral connection of the suction pipe which represents a considerable flow resistance, and which during suction leads to unpleasant noise development and makes the use of larger, more powerful and energy-dissipating fan motors necessary.

The device known from U.S. Pat. No. 3,002,513 is also disadvantageous because liquid overflowing from the cooking pots is entirely "captured" by the device encompassing the edge of the cooking pots in a circular manner and from below, and the possibility of cleaning the interior of the now soiled exhaust device is essentially not provided here.

A further drawback of this device for drawing in cooking vapors may be seen to be that the user has to be restricted to a specific size of cooking pot. Thus the diameter of the cooking vapor suction device which is circular in plan view limits the diameter of the cooking pots which may be used there and, moreover, prevents the otherwise conventional simultaneous use of two adjacent hobs for heating an elongate fish fryer.

A cooking vapor exhaust system emerges from U.S. Pat. No. 3,766,906 for a plurality of adjacent table broilers in a restaurant. In this cooking vapor exhaust system, the cooking vapors rising from the respective broiler are initially drawn horizontally to the side by means of a flow baffle plate projecting over the table surface and then drawn downward and subsequently supplied to a main suction pipe leading outside. The cooking vapor entry region of this cooking vapor exhaust device has a ducting system comprising a plurality of sharp-edged 900 bends which guides the drawn-in cooking vapor steam in a manner which has very high turbulence and thus has a high degree of flow resistance.

It is the object of the present invention, therefore, to provide a device for removing cooking vapors In a direction vertically below a hob plane, which permits the interior of the kitchen unit receiving the exhaust device according to the invention and which is usable for drawers, cupboards or storage to be able to be substantially unobstructed and thus incorporated in kitchen units in a manner which is particularly space-saving and protects the useful space and the in-system flow resistances thereof are particularly low and therefore allows the use of particularly small fans with particularly low power consumption and noise development—in comparison with the powerful fans used in cooking vapor exhaust devices of the prior art, which has excellent efficiency and therefore reliably and entirely removes cooking vapor steam rising above the central geometric region of the bottom surface of the cooking pots, which does not directly "capture" liquids which have boiled over from the cooking pots, which has an excellent capacity for cleaning and which does not impose a restriction on the user as regards the size of cooking pot.

Embodiments of the invention are disclosed in more detail with reference to the drawings, in which:

FIG. 1 shows a schematic oblique perspective view of a cooking vapor exhaust device according to the invention from the top right, the flat exhaust air duct thereof initially extending to the rear, bent in the direction of the rear wall of the kitchen base unit at a 90° angle and subsequently being guided further to the rear through an intermediate flat duct part, in order then to undergo a 90° deflection downward via a further intermediate flat duct part, a kitchen base unit with two hobs being shown in partially sectioned form in the lower part of FIG. 1, between which the cooking vapor exhaust device shown in the upper part of FIG. 1 is inserted;

Figure 5:
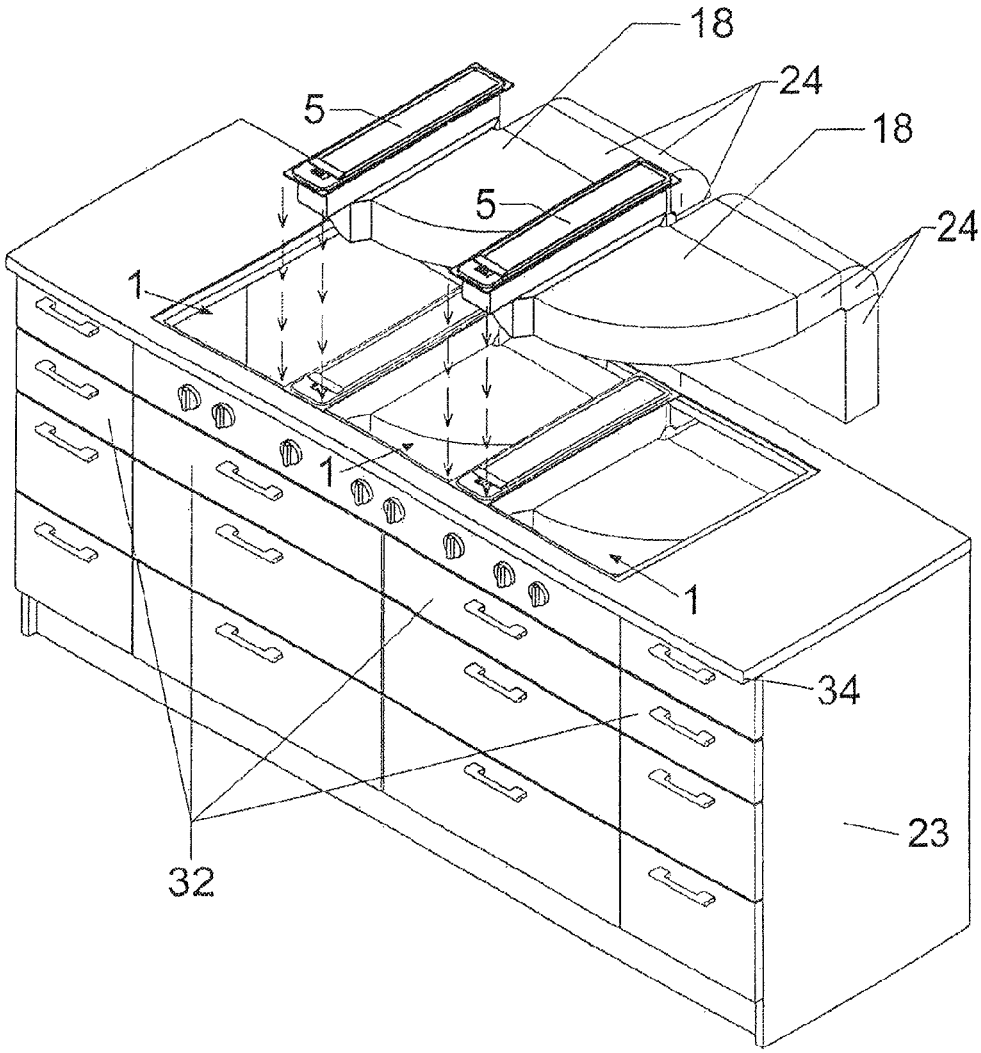
Figure 6:
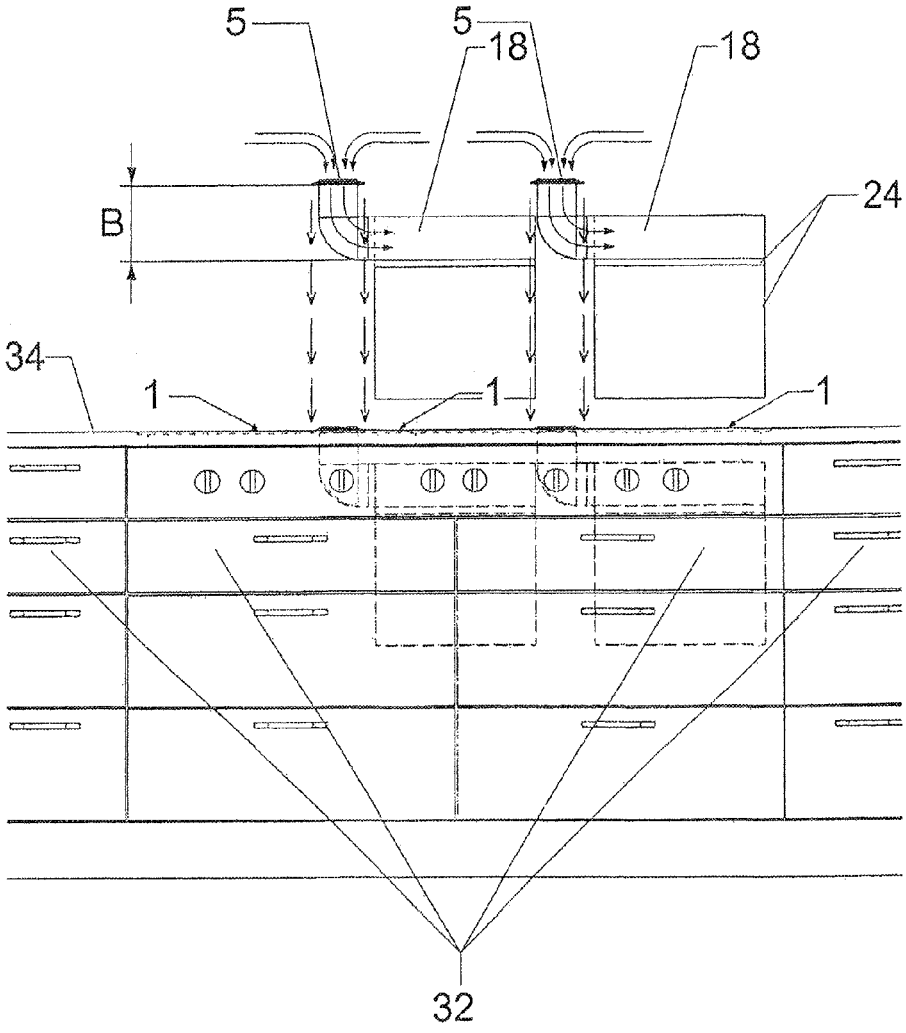

FIG. 5 shows a schematic, oblique perspective view from the top right of two cooking vapor exhaust devices according to the invention provided adjacent to one another, the flat exhaust air ducts thereof extending to the rear, bent back at a 90° angle initially in the direction of the rear wall of the kitchen base unit and subsequently being guided further to the rear by one respective intermediate flat duct part, in order then to undergo a 90° deflection downward via one respective further intermediate flat duct part, a kitchen base unit being shown in the lower part of FIG. 5 in partially sectioned form with three hobs, between which the two cooking vapor exhaust devices shown in the upper part of FIG. 5 are inserted;

FIG. 6 shows a forward front view of the two cooking vapor exhaust devices arranged adjacent to one another shown in FIG. 5, the front view of a kitchen base unit being shown in the lower part of FIG. 6, in which the cooking vapor exhaust device shown in the upper parts of FIGS. 5 and 6 is inserted.

Figure 7:
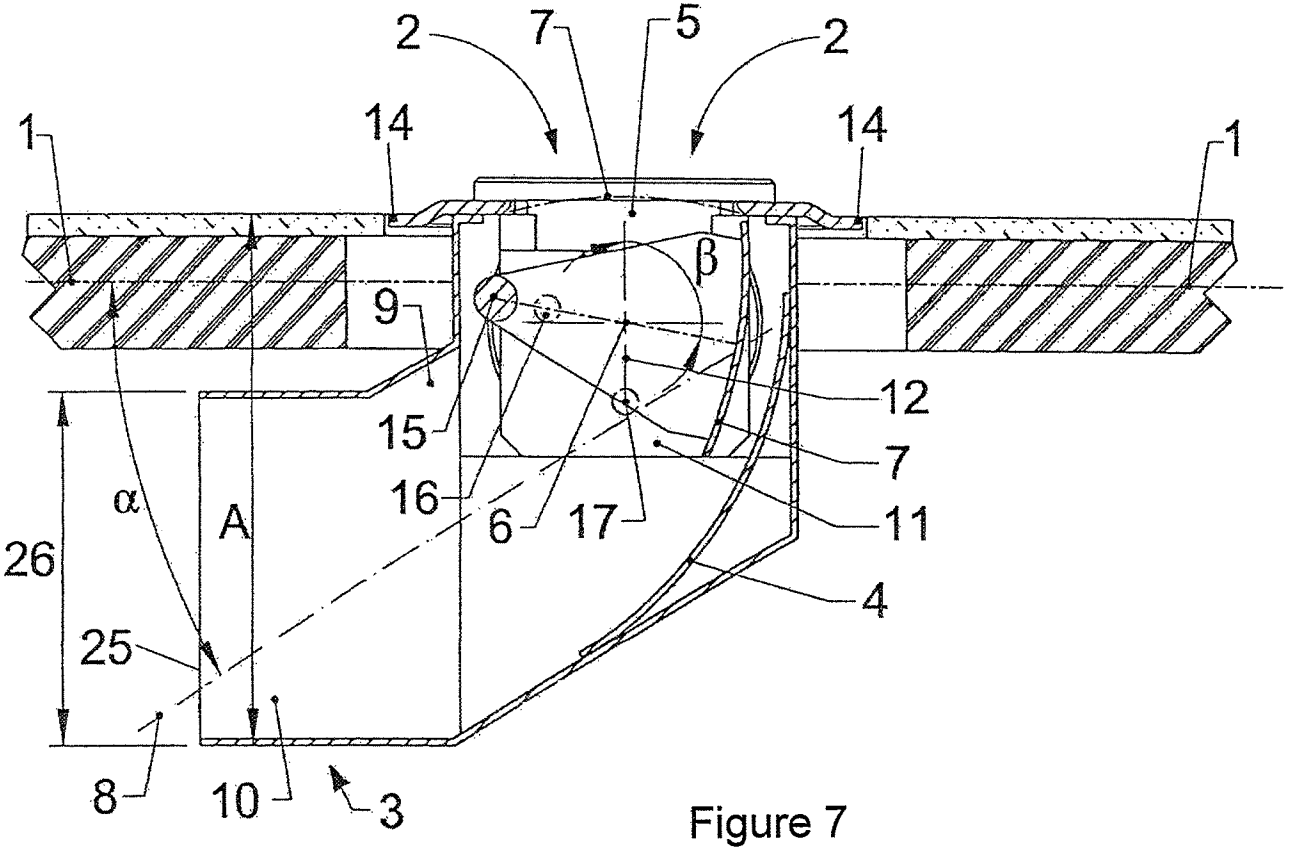
Figure 8:
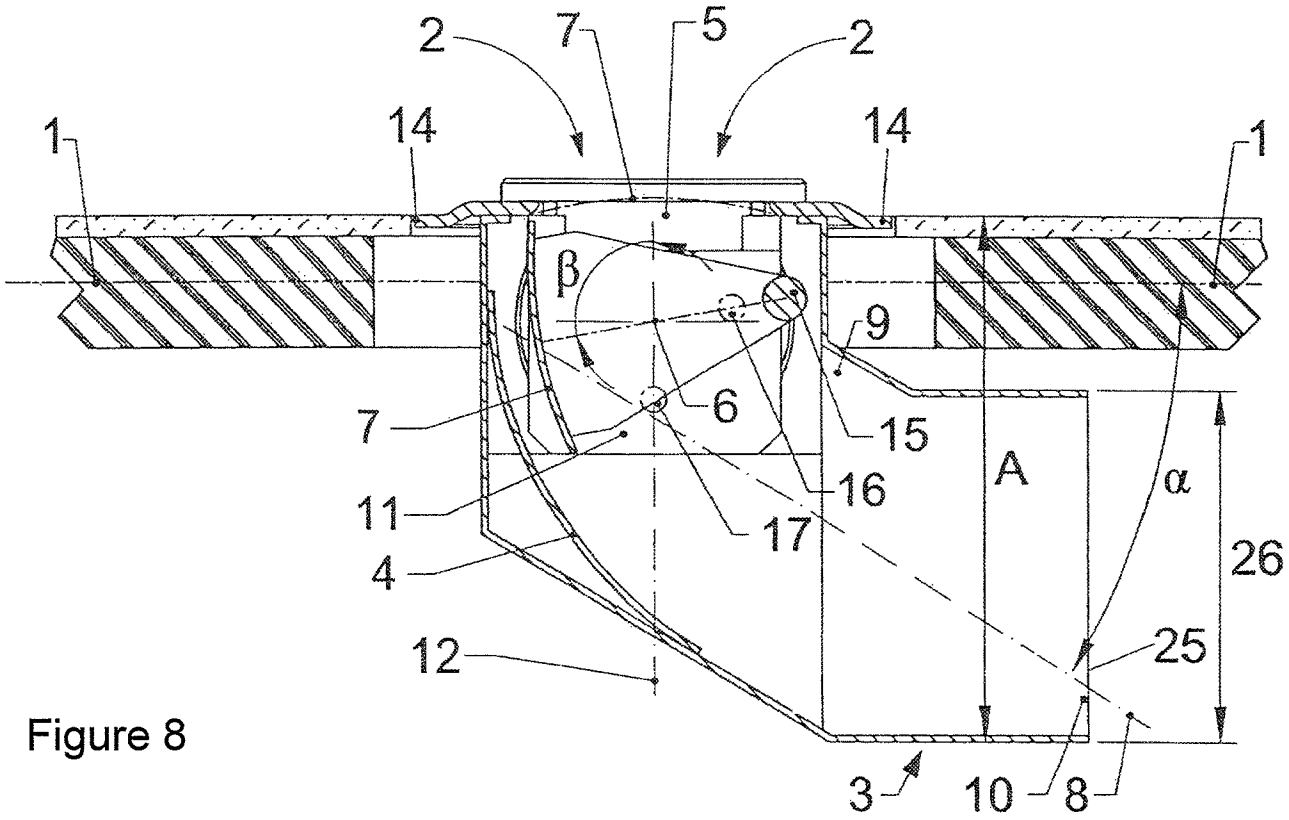
Figure 9:
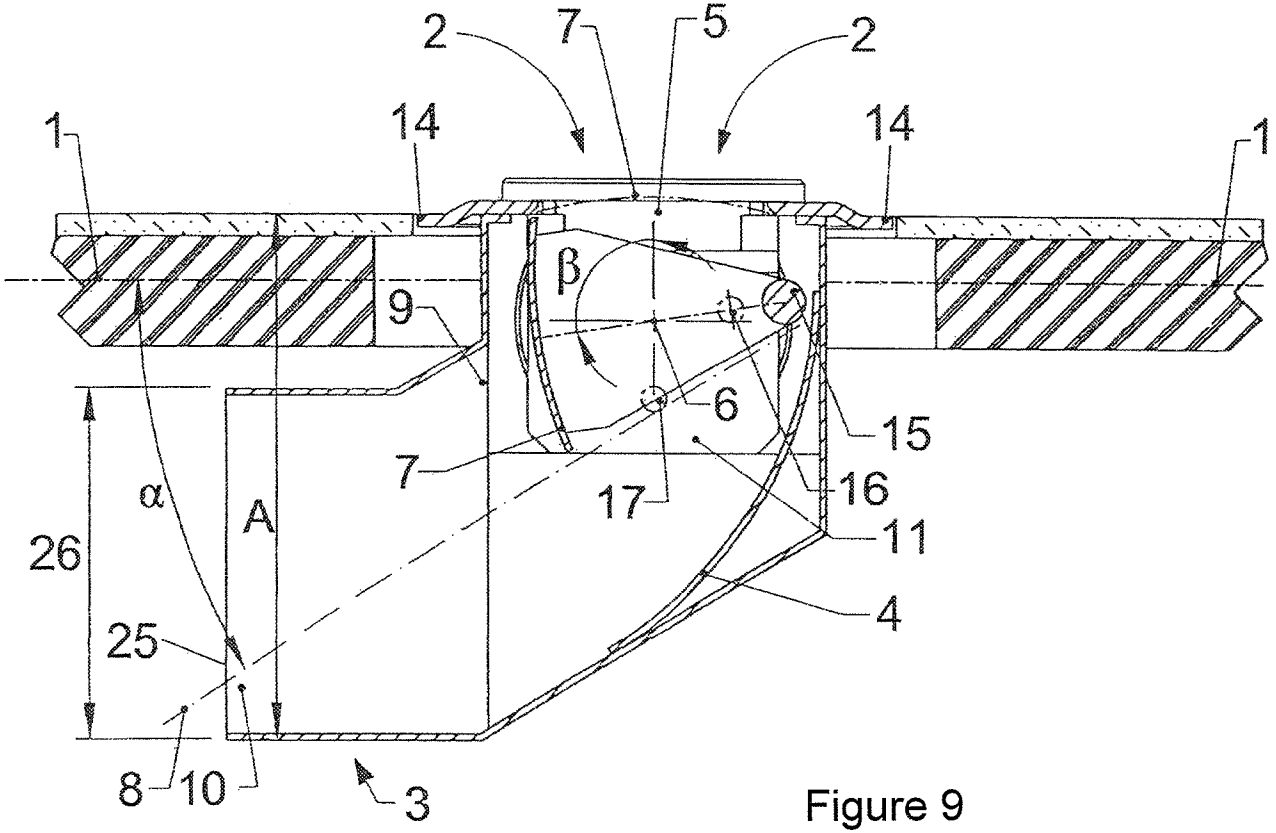
Figure 10:
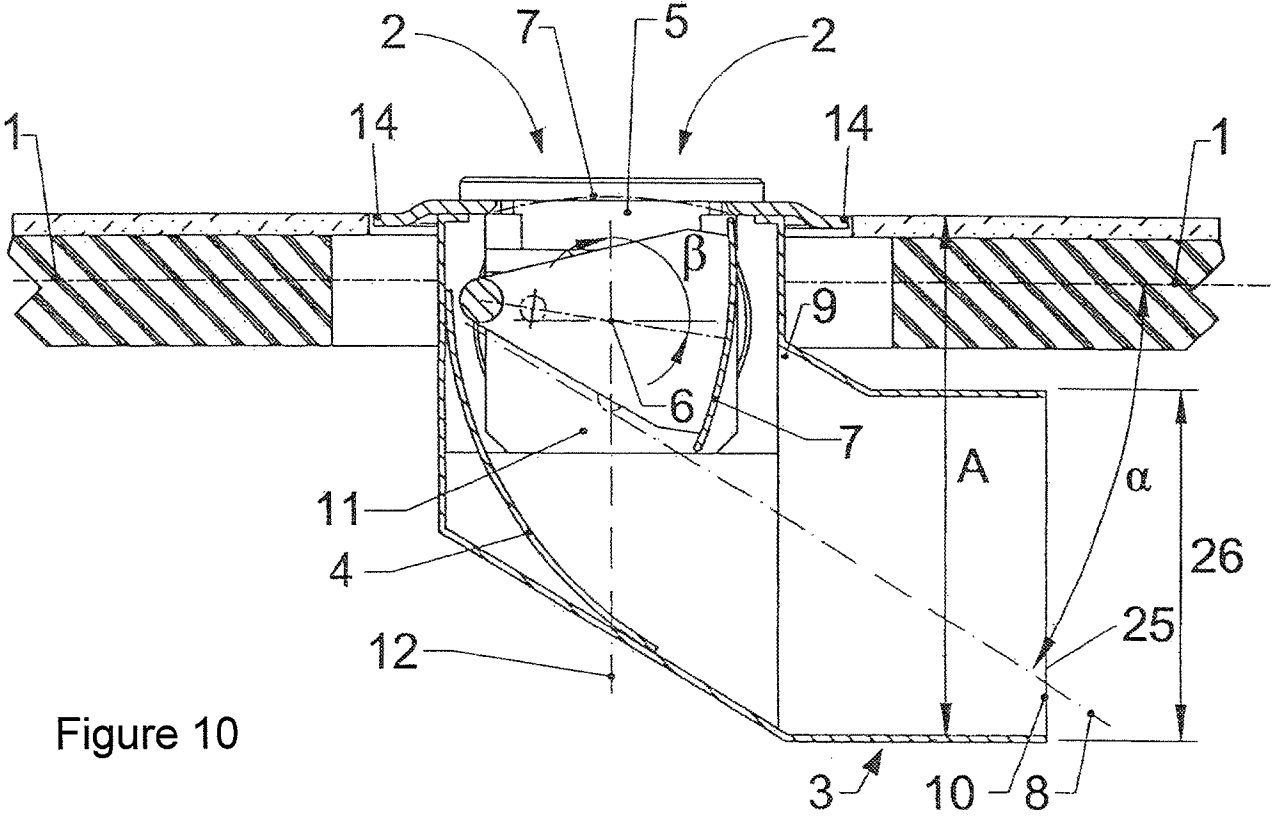
Figure 11:
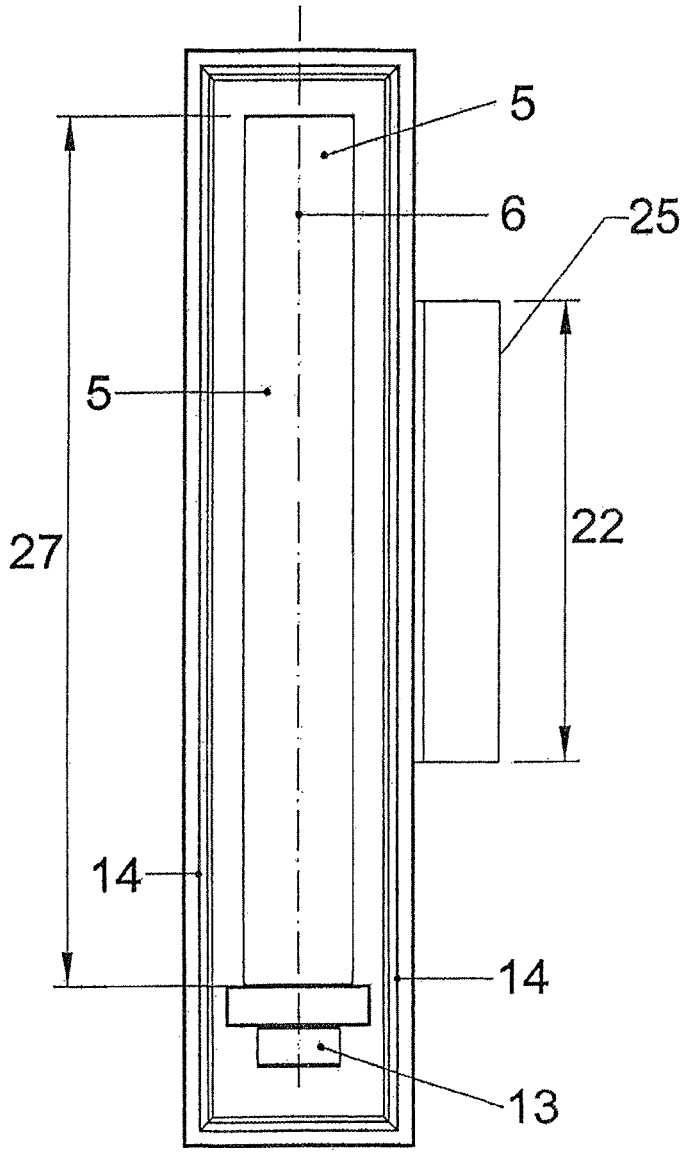
Figure 12:
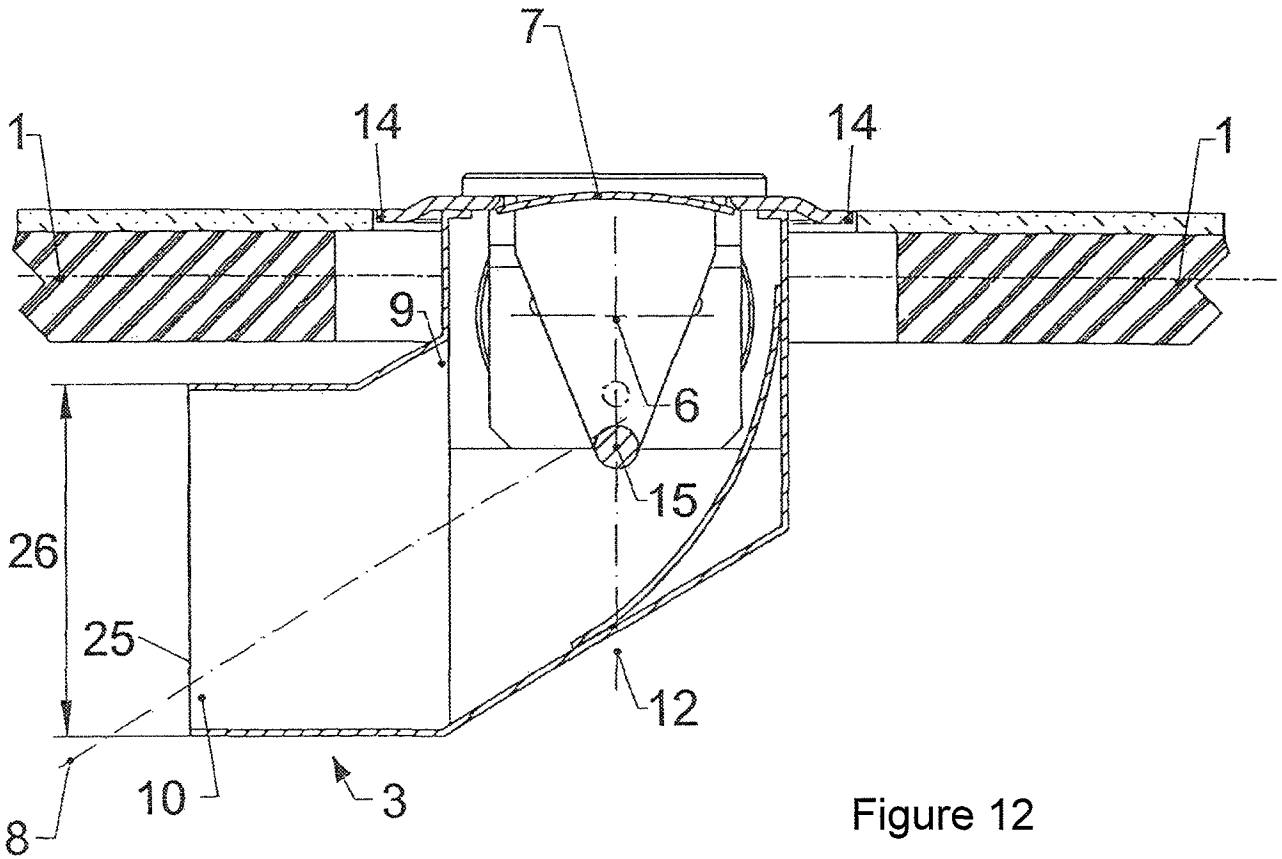
Figure 13:
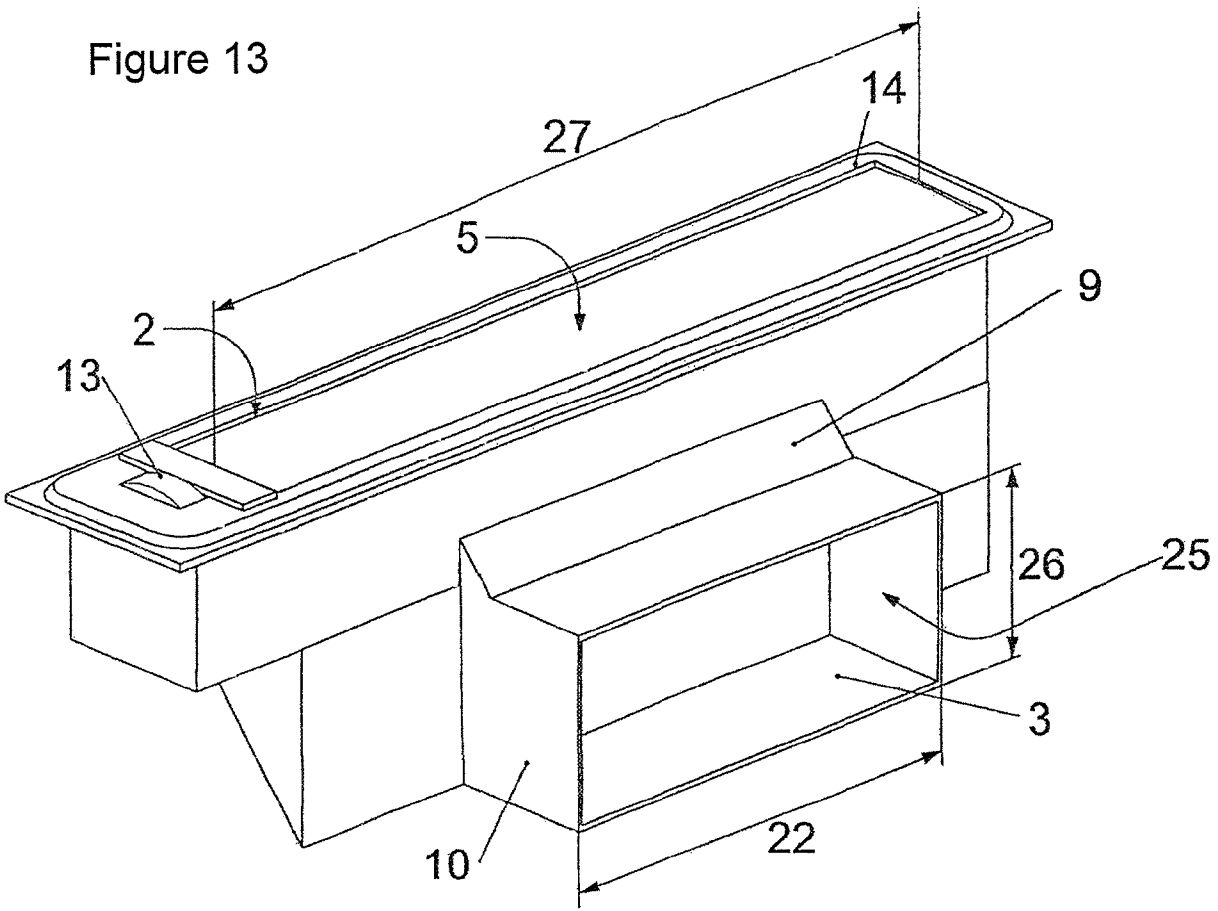
Figure 14:
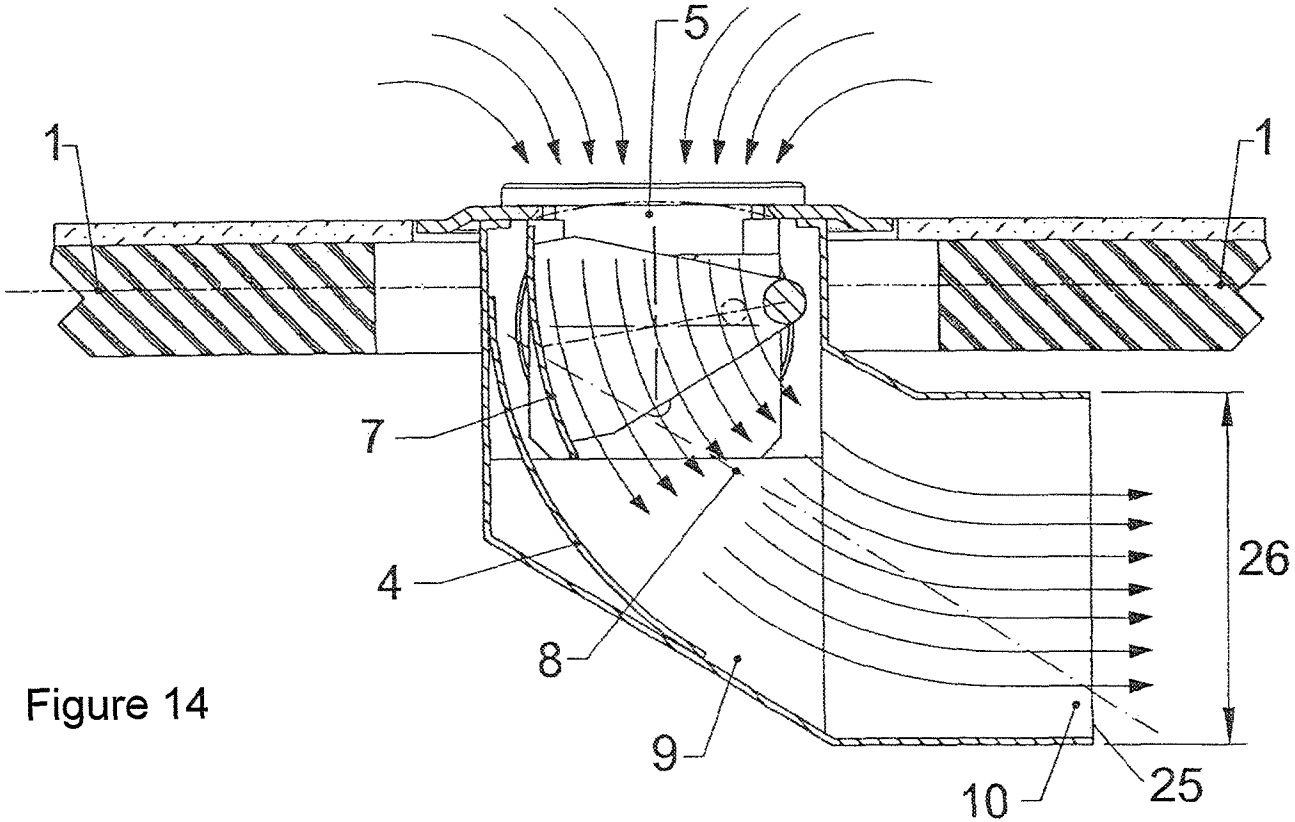
Figure 15:
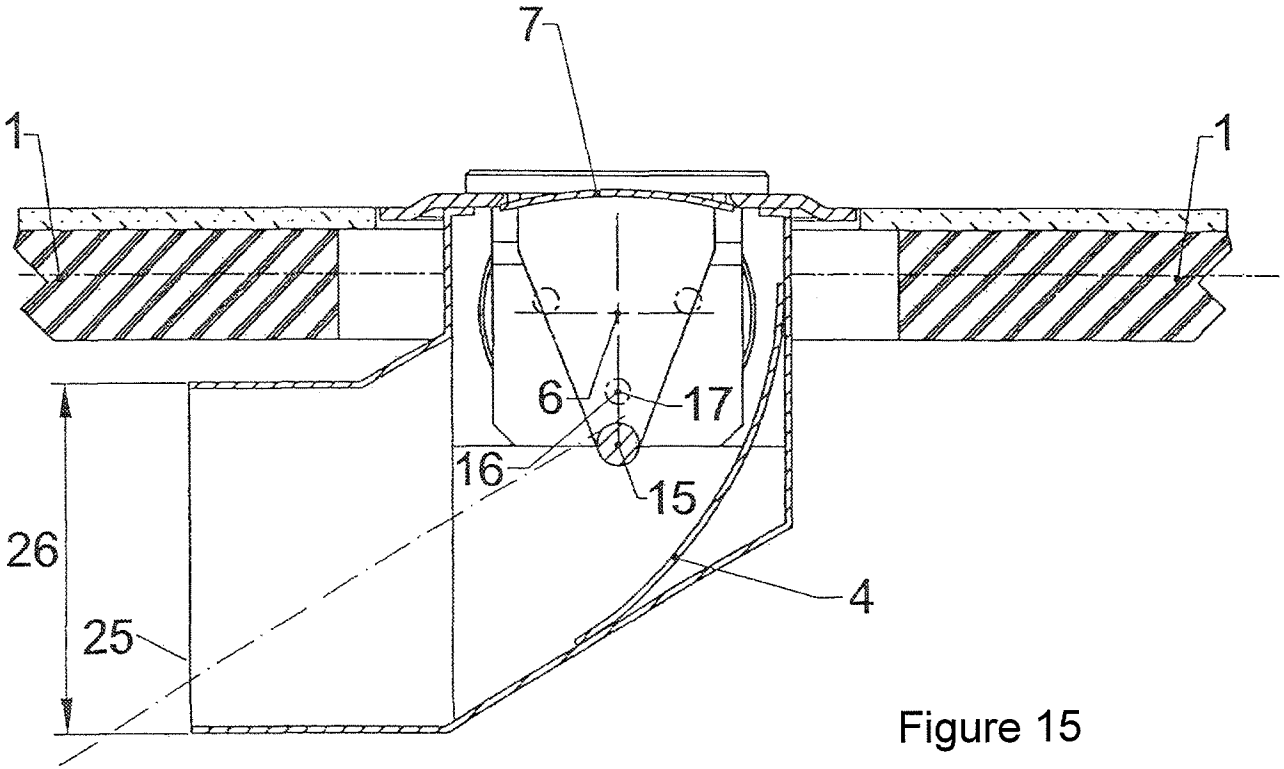
Figure 16:
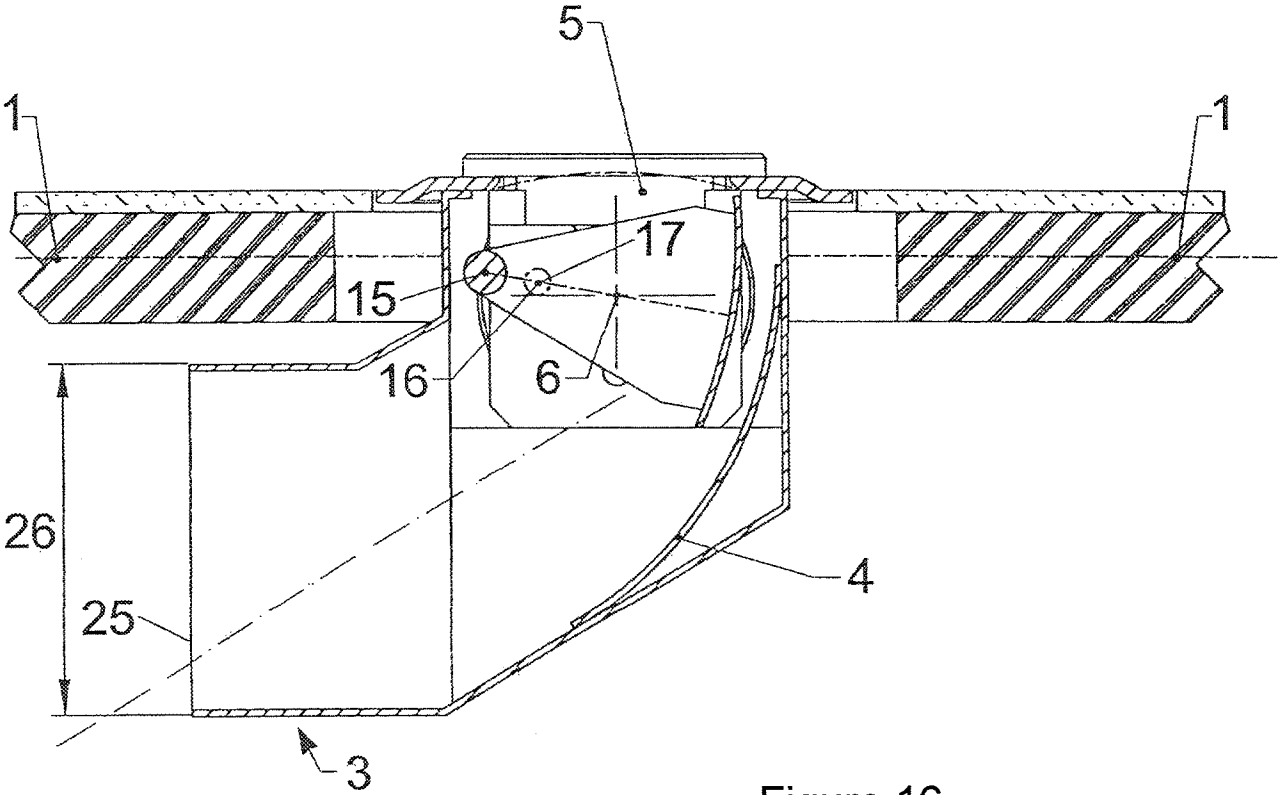
Figure 17:
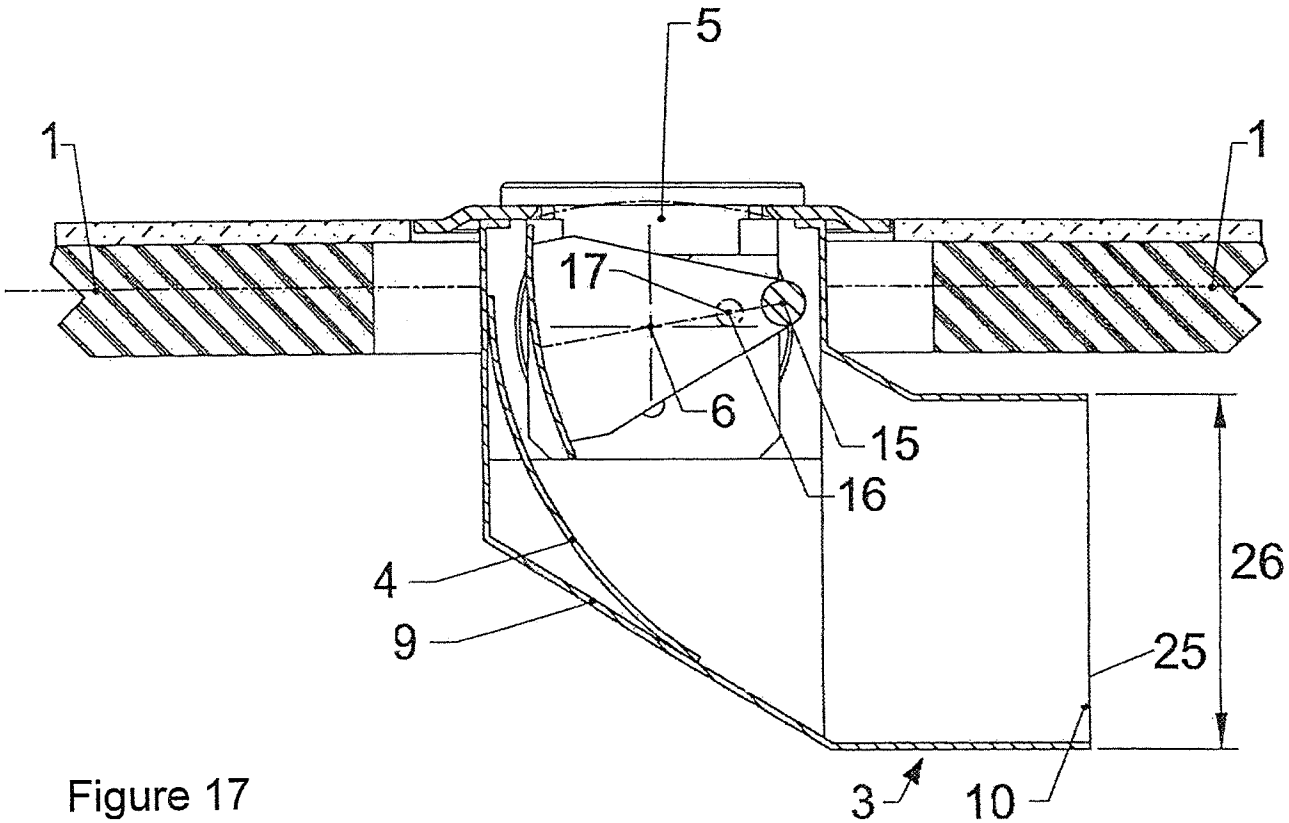
Figure 18:
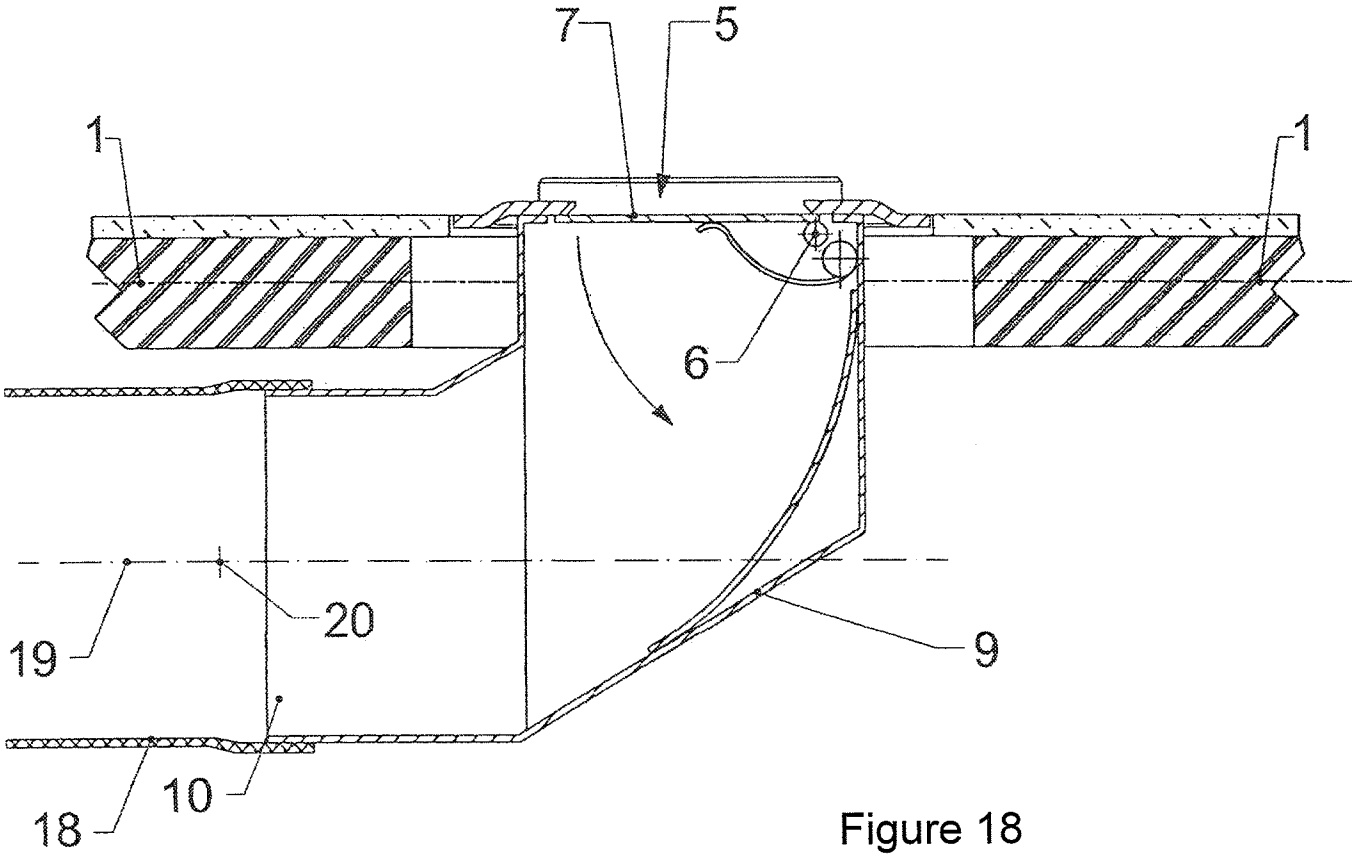
Figure 19:
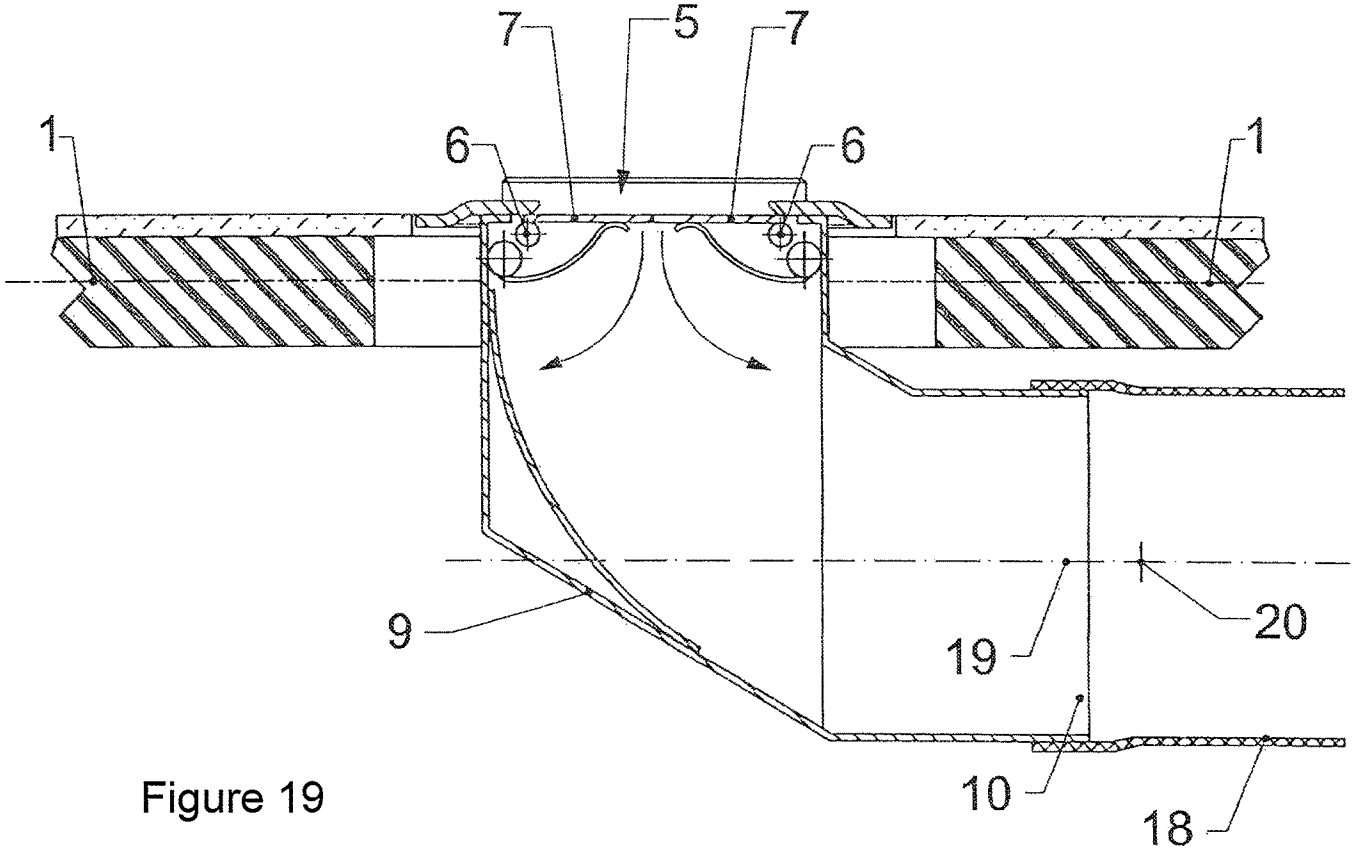
Figure 20:
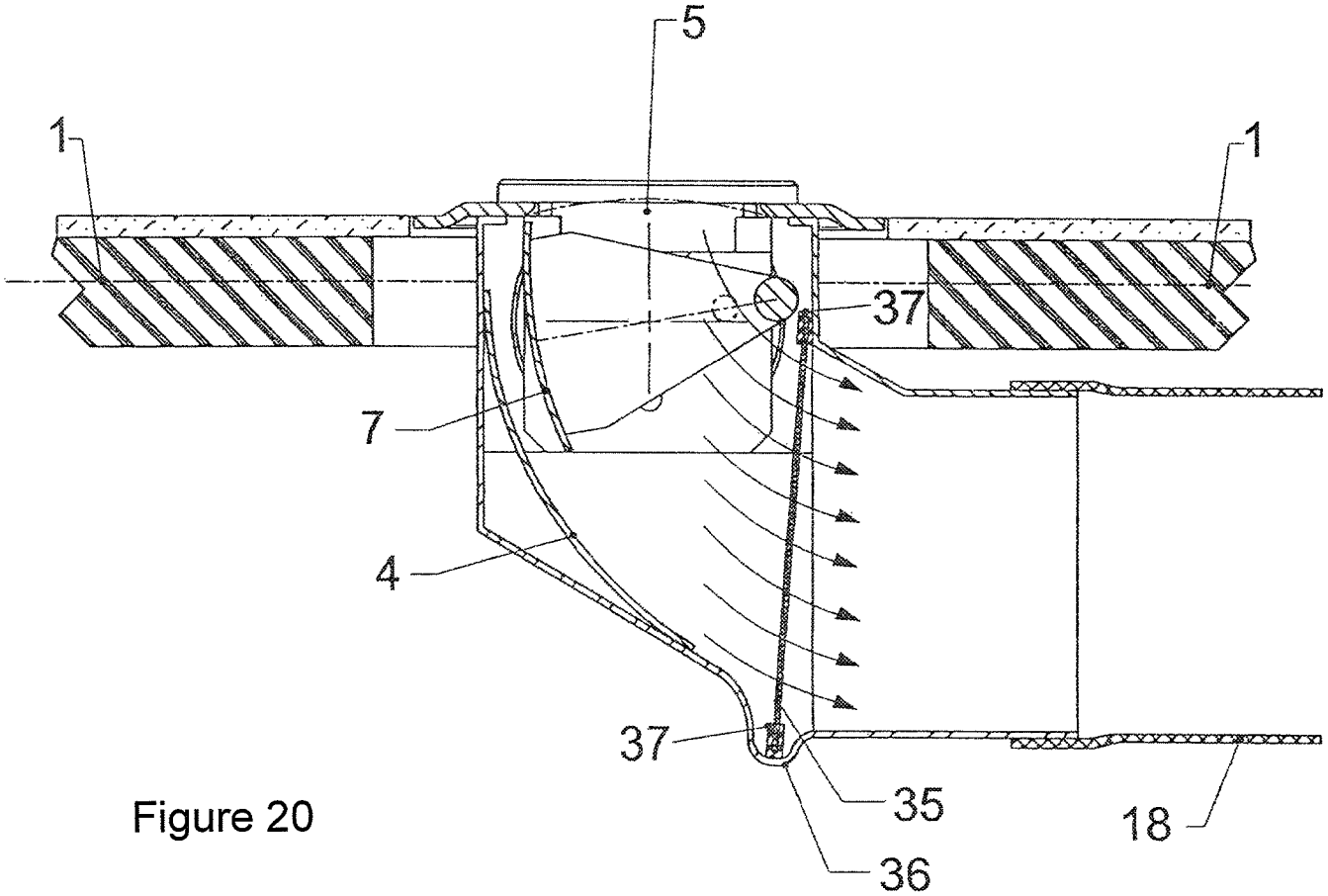

FIG. 7 shows a schematic cross section through an exhaust device according to the invention, in which the preliminary section of an exhaust air duct is connected from bottom left at an angle to a cooking vapor entry device, the closure element of the cooking vapor entry device being pivoted to the side into the 4 o'clock position relative to the rotational axis thereof;

FIG. 8 shows a schematic cross section through an exhaust device according to the invention, in which the preliminary section of an exhaust air duct is connected from bottom right at an angle to a cooking vapor entry device and the closure element of the cooking vapor entry device being pivoted to the side into the 8 o'clock position relative to the rotational axis thereof;

FIG. 9 shows a schematic cross section through an exhaust device according to the invention, in which the preliminary section of an exhaust air duct is connected from bottom left at an angle to a cooking vapor entry device, the deflection without turbulence of the occurring cooking vapors taking place by means of the wall of the cooking vapor entry device which is curved in a concave manner in the 3 o'clock position of the rotational axis of the closure element, and the closure element of the cooking vapor entry device being pivoted to the side into the 9 o'clock position relative to the rotational axis thereof;

FIG. 10 shows a schematic cross section through an exhaust device according to the invention, in which the preliminary section of an exhaust air duct is connected from bottom right at an angle to a cooking vapor entry device, the deflection without turbulence of the occurring cooking vapors taking place by means of the wall of the cooking vapor entry device which is curved in a concave manner in the 9 o'clock position of the rotational axis of the closure element, and the closure element of the cooking vapor entry device being pivoted to the side into the 3 o'clock position relative to the rotational axis thereof;

FIG. 11 shows a schematic plan view of an exhaust device according to the invention with a mounting frame configured as an overflow protection which encompasses in a peripheral manner the entry opening of the cooking vapor entry device located at the top and comprises a lateral recess for the rotary wheel for the closure element;

FIG. 12 shows a schematic cross section through an exhaust device according to the invention, in which a rotatable closure element closes the entry opening of the cooking vapor entry device in a 12 o'clock position relative to the rotational axis;

FIG. 13 shows a schematic perspective view of an exhaust device according to the invention from top left at an angle with a preliminary section shown foreshortened and a connecting section of an exhaust air duct;

FIG. 14 shows a schematic cross section through an exhaust device according to the invention in which the path of the isobaric, laminar flow lines is illustrated;

FIG. 15 shows a schematic cross section through an exhaust device according to the invention in which the rotatable closure element closes the entry opening of the cooking vapor entry device in the 12 o'clock position relative to the rotational axis, whilst the counter weight for compensating the dead weight of the closure element is located in the 6 o'clock position relative to the rotational axis and in this position is magnetically locked by a first positioning magnet attached to a counter weight, interacting with a positioning magnet on the housing side;

FIG. 16 shows a schematic cross section through an exhaust device according to the invention in which the rotatable closure element opens the entry opening of the cooking vapor entry device in the 3 o'clock position relative to the rotational axis, whilst the counter weight for compensating the dead weight of the closure element is located in the 9 o'clock position relative to the rotational axis, and in this position is magnetically locked by a first positioning magnet attached to the counter weight interacting with a positioning magnet on the housing side;

FIG. 17 shows a schematic cross section through an exhaust device according to the invention in which the rotatable closure element opens the entry opening of the cooking vapor entry device in the 9 o'clock position relative to the rotational axis, whilst the counter weight for compensating the dead weight of the closure element is in the 3 o'clock position relative to the rotational axis and in this position is magnetically locked by a first positioning magnet attached to the counter weight interacting with a positioning magnet on the housing side;

FIG. 18 shows a schematic cross section through a cooking vapor exhaust device according to the invention, in which the closure element is configured in the form of a one-piece, spring-loaded flap, which when actuating a fan motor automatically folds away downward, opening the entry opening of the cooking vapor exhaust device, and after the fan motor is switched off automatically folds upward again into the horizontal, accompanied by a closure of the entry opening of the cooking vapor exhaust device;

FIG. 19 shows a schematic cross section through a cooking vapor exhaust device according to the invention, in which the closure element is configured in the form of two respective spring-loaded flaps which in the closed state tightly abut one another or overlap, in the manner of a swing door, which when actuating a fan motor automatically fold away downward, opening the entry opening of the cooking vapor exhaust device and after the fan motor is switched off automatically fold upward again into the horizontal, accompanied by a closure of the entry opening of the cooking vapor exhaust device;

FIG. 20 shows a schematic cross section through a cooking vapor exhaust device according to the invention, having a fat smoke filter element inserted in the downstream portion of the connecting section of the exhaust air duct at an angle to the flow direction of the drawn-in cooking vapor flow.

As already emerges from FIG. 1, the device according to the invention for removing cooking vapors in a direction vertically below a hob plane (1) generally has a cooking vapor entry device (2) that can be reversibly opened and closed.

Figure 1:
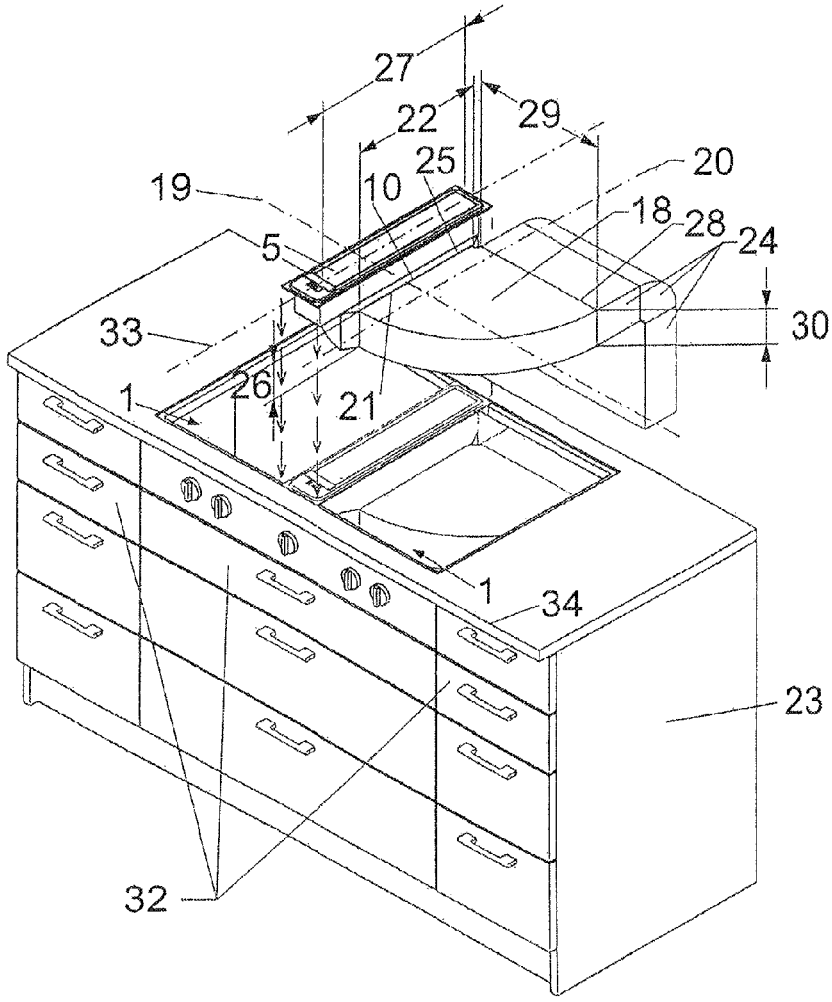
Figure 2:
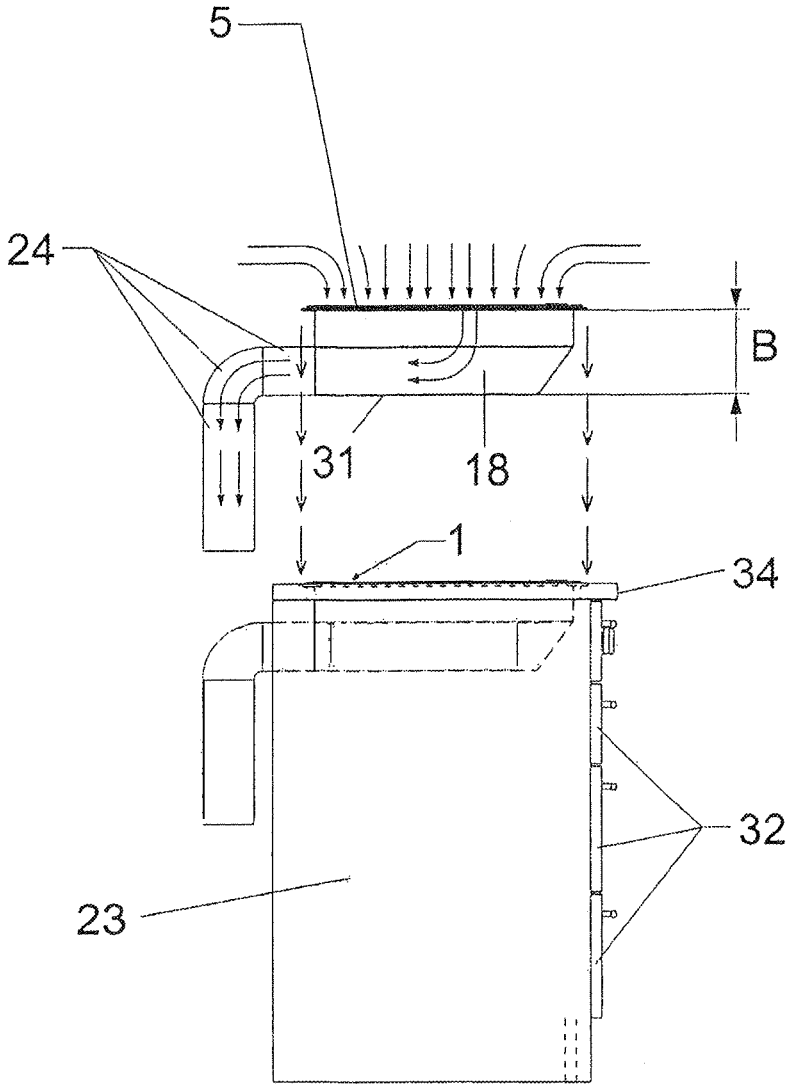
FIG. 2 shows a side view of the cooking vapor exhaust device shown in FIG. 1, the side view of a kitchen base unit being shown in the lower part of FIG. 2, in which the cooking vapor exhaust device shown in the upper parts of FIGS. 1 and 2 is inserted.
Figure 3:
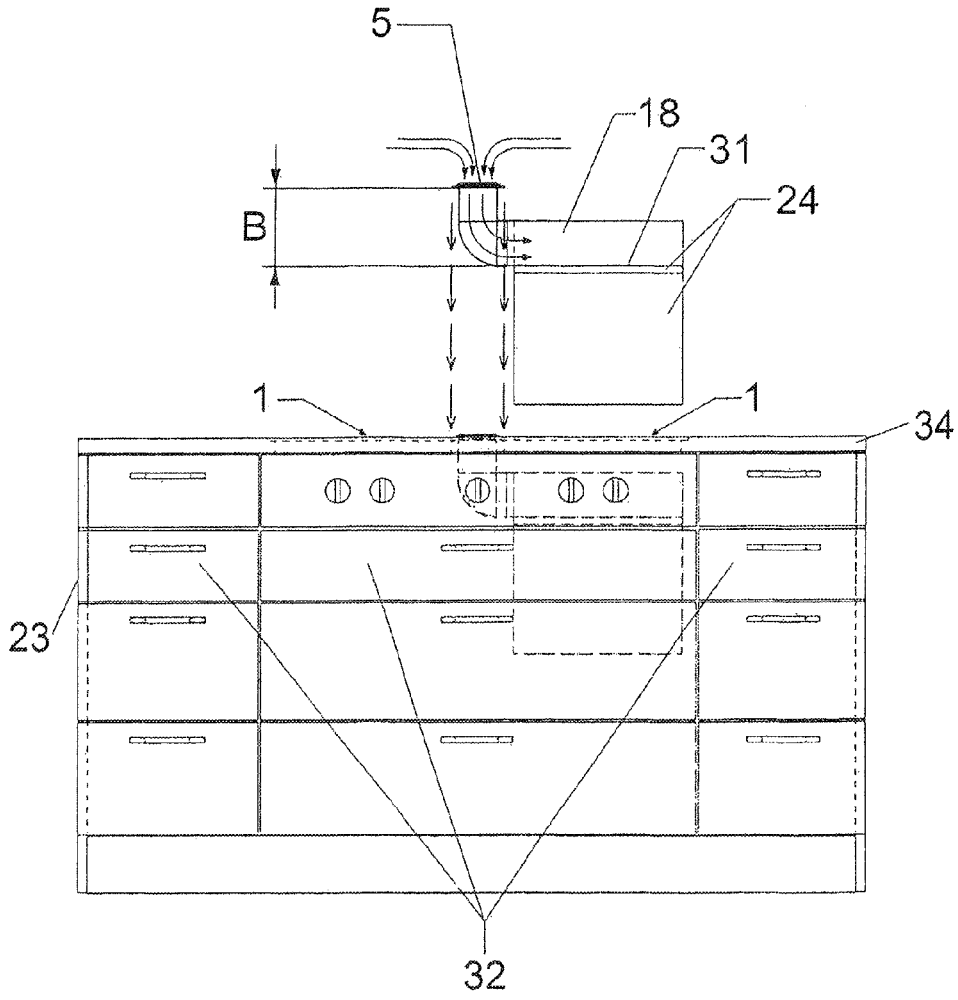
FIG. 3 shows a forward front view of the cooking vapor exhaust device shown in FIGS. 1 and 2, the front view of a kitchen base unit being shown in the lower part of FIG. 3, in which the cooking vapor exhaust device shown in the upper parts of FIGS. 1 and 2 is inserted.
Figure 4:
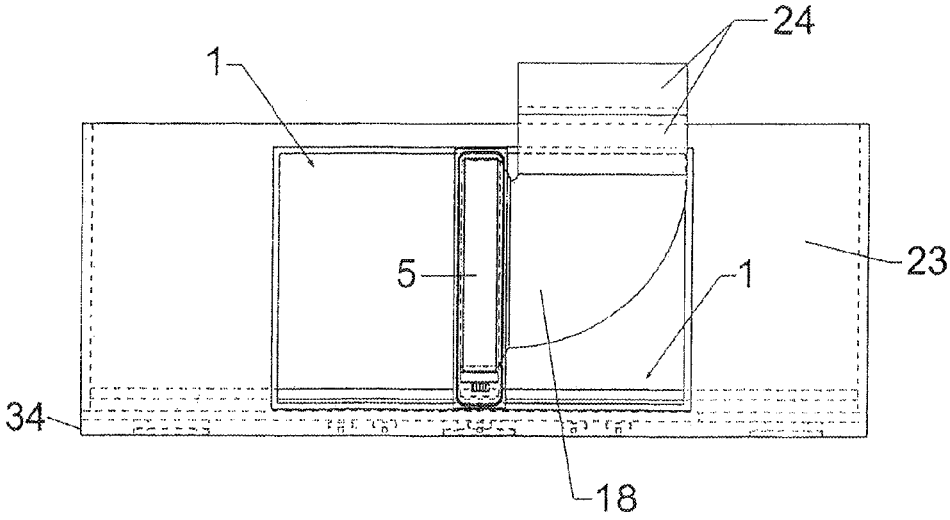
FIG. 4 shows a plan view of a kitchen base unit with two hobs arranged adjacent to one another, between which a cooking vapor exhaust device shown in FIGS. 1, 2 and 3 is provided.

Also revealed from FIG. 1 is that the device according to the invention for removing cooking vapors generally may comprise one or more single or multi-part exhaust air ducts (3) connected downstream relative to an imaginary vertical line (12) through the cooking vapor entry device (2) indirectly or directly from the side at a right angle and horizontally or from the side from below at an angle to the lower side and/or to a lateral flank of the cooking vapor entry device (2).

As FIG. 1 already shows, a connecting section (10) of the exhaust air duct (3) may be provided downstream on the cooking vapor entry device (2), either indirectly with a preliminary section (9) of the exhaust air duct (3) interposed or directly.

Preferably, the downstream exit opening (25) of the connecting section (10) of the exhaust air duct (3) may be configured in the form of a horizontally extending rectangle, an oblong hole or a slot.

Generally, the width (22) of said exit opening (25) of the connecting section (10) of the exhaust air duct (3) is larger than the height (26) thereof.

The width (22) of said exit opening (25) may correspond approximately to the width (27) of the entry opening (5) of the cooking vapor entry device (2).

One or more flat duct elements (18) having respective horizontally extending, rectangular cross-sections may be connected to the cooking vapor entry device (2) and/or to the preliminary section (9) of the exhaust air duct (3) and/or to the connecting section (10) of the exhaust air duct (3), either indirectly or directly, downstream of the exit opening (25) of the connecting section (10) of the exhaust air duct (3) from the side and horizontally and/or from the side and from below at an angle.

Generally, the longitudinal axis (19) and the transverse axis (20) of the first flat duct element (18) connected downstream indirectly or directly to the cooking vapor entry device (2)

and/or to the preliminary section (9) of the exhaust air duct (3) and/or to the connecting section (10) of the exhaust air duct (3) may be horizontally aligned.

Preferably, said downstream first flat duct element (18) is configured in the form of a 90° horizontal bend.

As emerges, in particular, from FIG. 1, the width (29) and the height (30) of the downstream exit opening (28) extending horizontally in cross section of said downstream first flat duct element (18) may correspond approximately to the width (22) and the height (26) of the exit opening (25) of the connecting section (10) of the exhaust air duct (3).

Generally, the width and the height of the upstream entry opening (21) of the first flat duct element (18), extending horizontally in cross section, approximately correspond to the width (22) and the height (26) of the exit opening (25) of the connecting section (10) of the exhaust air duct (3).

Generally, the exit opening (28) extending horizontally in cross section of said first downstream flat duct element (18) may face to the rear, in the direction of the rear face of the kitchen base unit (23) receiving the device for removing cooking vapors.

Generally, one or more further flat duct elements (24) may be provided downstream of the exit opening (28) of the first flat duct element (18) extending horizontally in cross section in the form of a 90° horizontal bend.

These further flat duct elements (24) may lead to the rear and/or downward and/or upward and/or to the side.

Preferably, the entry openings and exit openings of the further flat duct elements (24) with reference to their vertical height and their horizontal width may have respective dimensions which approximately correspond to the vertical height (26) and the horizontal width (22) of the downstream exit opening (25) of the connecting section (10) of the exhaust air duct (3).

It is particularly advantageous, in the case of the device according to the invention for removing cooking vapors, that the vertical spacing B between the entry opening (5) of the cooking vapor entry device (2) located at the vertical height of the hob plane (1) and the underside (31) of the downstream first flat duct element (18) configured in the form of a 90° horizontal bend, may be merely in the range of 20.0 cm to 10.0 cm, preferably in the range of 19.0 cm to 11.0 cm, in particular in the range of 17.0 cm to 12.0 cm.

The small configuration of the spacing B leads to the significant advantage that the space of a kitchen base unit (23) below the device for the removal of cooking vapors and below the flat duct elements (18, 24) leading away therefrom downstream, is useful for using drawers or slide-in modules or false bases, almost without any spatial restriction caused by exhaust air ducts provided downstream of the cooking vapor entry device.

As already may be derived from FIG. 1, in a plan view the longitudinal axes (33) of the entry openings (5) of the cooking vapor entry devices (2) may be aligned, for example at right angles to the forward front edge (34) of the kitchen base unit (23) bearing the device for removing cooking vapors.

The entry openings (5) may be integrated on one side or both sides laterally to a hob (1) or in the lateral edge regions thereof on one side or both sides or provided between two hobs (1).

A particularly significant feature of the device according to the invention for drawing in cooking vapors consists in that the cooking vapors drawn in over the entire width (27) of the entry opening (5) of the cooking vapor entry device (2) may be supplied in a manner which is substantially without turbulence and laminar and with low resistance in the flat duct elements (18, 24) to one or more fans or ventilators, maintaining the flow cross section approximately with the width (27) of the entry opening (5) of the cooking vapor entry device (2) and merely subjected to deflections, as well as maintaining the efficiency of the device for removing cooking vapors.

One or more external fans or ventilators may be provided in one of the further flat duct elements (24) or therebetween or on, or in, the downstream end region of the further flat duct elements (24).

As already emerges from FIG. 7, the device according to the invention, in particular, is a device for the removal of cooking vapors in a direction vertically below a hob plane (1).

Generally, the exhaust device according to the invention has at least one reversibly openable and closable cooking vapor entry device (2).

This reversible closability of the cooking vapor entry device (2) leads to the significant advantage that unpleasant odor as a result of stale fat in the fat filter (35) when the fan motor is switched off and thus during non-operation of the cooking vapor exhaust device according to the invention may be reliably avoided.

Preferably, the exhaust device according to the invention further comprises at least one exhaust duct (3) connected downstream relative to an imaginary vertical line (12) through the cooking vapor entry device (2) at an angle to the left or at an angle to the right indirectly or directly to the downstream lower side of the cooking vapor entry device (2), whereby a particularly flat spatial requirement results for the cooking vapor exhaust device according to the invention.

The longitudinal axis (8) of the preliminary section (9) of the exhaust air duct (3) generally encloses with the hob plane (1) an angle $\alpha$, which for example may be in the range of 20° to 70°, preferably in the range of 30° to 60°, in particular in the range of 40° to 45°.

In a first alternative embodiment of the exhaust device according to the invention, the deflection of the occurring cooking vapor flow which is as laminar as possible for reducing the flow resistance, may take place in the direction of the obliquely connected preliminary section (9) of the exhaust air duct (3) by means of a design which is oblique or curved in a concave manner of the wall (4) opposing the preliminary section (9) of the exhaust duct (3) of the cooking vapor entry device (2).

In a second alternative embodiment of the exhaust device according to the invention, the deflection of the occurring cooking vapors which is as laminar as possible for reducing the flow resistance, may take place in the direction of the obliquely connected preliminary section (9) of the exhaust air duct (3), alternatively or additionally to the curvature or oblique position of the wall of the cooking vapor entry device, by means of a closure element (7) which in cross section is straight or curved in a concave manner and rotated or pivoted or folded to the side, opposing the connecting point of the preliminary section (9) of the exhaust air duct (3) on the cooking vapor entry device (2).

The lateral deflection of the cooking vapor flow occurring in the cooking vapor device (2), (see FIG. 14) which is as laminar as possible and without turbulence, for reducing the flow resistance in the direction of the obliquely connected preliminary section (9) of the exhaust air duct (3) leads, in particular, to the advantages that a weaker and smaller fan motor is sufficient, the power consumption thereof and operating noise development being low. Moreover, by this deflection which is as laminar as possible the flow noise within the cooking vapor exhaust device according to the invention is considerably reduced.

A particularly significant feature of the cooking vapor exhaust device according to the invention is seen to be that a connecting section (10) of the exhaust air duct (3) may be connected downstream to the oblique preliminary section (9) of the exhaust air duct (3), said connecting section (10) of the exhaust air duct (3) possibly being aligned at least partially or partially parallel or obliquely to the hob plane (1).

Generally, the spacing A between the surface of the hob (1) and the underside of the more horizontal connecting section (10) of the exhaust air duct (3) is, for example, in the range of 70 mm to 205 mm, preferably in the range of 80 mm to 200 mm, in particular in the range of 90 mm to 150 mm.

In particular, due to this very small spacing A which may be implemented for the first time by the cooking vapor exhaust device according to the invention, from now on kitchen units may be provided with a cooking vapor exhaust device, without appreciable loss of useful internal space for drawers or cupboards in kitchen units which carry the cooking vapor exhaust device according to the invention.

As in particular emerges from FIGS. 7 to 10, the exhaust device according to the invention generally has an entry opening (5) facing upward vertically, and an exit opening (11) facing downward opposing said entry opening.

Generally, the entry opening (5) of the cooking vapor entry device (2) which is aligned vertically upward may be reversibly closed and opened by a closure element (7) which may be rotated and/or pivoted and/or folded about a horizontal rotational axis (6).

Preferably, the closure element (7) in cross section—relative to its horizontal rotational axis (6)—is able to be rotated or pivoted to and fro reversibly at least between a 12 o'clock position closing the entry opening (5) and a 2 o'clock position, 3 o'clock position, 4 o'clock position or 5 o'clock position opening the entry opening (5), on the one hand, or 10 o'clock position, 9 o'clock position, 8 o'clock position or 7 o'clock position, on the other hand.

In particularly preferred embodiments of the cooking vapor exhaust device according to the invention, for the complete or partial compensation of the dead weight of the closure element (7) which may be rotated or pivoted or folded about its rotational axis (6), a counter weight (15) may be provided acting on the other side of the rotational axis (6).

The provision of the counter weight (15) for compensating the dead weight of the closure element (7) leads, in particular, to the advantage that already very low forces are sufficient for rotating or pivoting the closure element (7) about its rotational axis (6). In particular, therefore, the rotational forces to be applied to the manually drivable rotary wheel (13) are very small.

In particularly preferred embodiments of the device according to the invention, one or more devices may be provided for the indirect or direct engagement or snapping-in or clamping of the rotatable or pivotable closure element (7) in its position closing the entry opening (5) of the cooking vapor entry device (2) and/or in its positions opening the entry opening (5) of the cooking vapor entry device (2).

In particular from FIGS. 7 to 10, it emerges that in cross section through the pivot point (6) of the closure element (7), for example a straight or curved arm may extend which at one free end bears the closure element (7) and at its opposing free end bears a counter weight (15) for compensation of the dead weight of the closure element (7).

Also, in particularly preferred embodiments of the cooking vapor exhaust device according to the invention, at least one first positioning magnet (16) may be reversibly or irreversibly attached to the rotatable or pivotable or foldable closure element (7) and/or additionally to the counter weight (15) and/or between the counter weight (15) and the rotational axis (6).

Preferably, therefore, on the housing side at least one second positioning magnet (17) aligned with opposing poles is reversibly or irreversibly provided.

The attachment of said positioning magnets (16, 17) leads to the advantage that the closure element (7) in its position closing the entry opening (5) and/or in its position opening the entry opening (5) and/or in its position deflecting the occurring cooking vapors in a laminar manner, may be magnetically locked securely and the respective position is automatically locked. Preferably, the corresponding position of the closure element (7) may be detected manually via different rotational resistances.

Instead of the provision of a positioning magnet (17) on the housing side and a further positioning magnet (16) on the closure element side or counter weight side, naturally a positioning magnet (16, 17) may be provided on only one side whilst the counterpart on the other side is produced from a ferromagnetic material, for example.

In particular from FIGS. 15 to 17, it follows that the at least one positioning magnet (17) on the housing side, when considering a cross section relative to the rotational axis (6), may be provided in the 2 o'clock position, 3 o'clock position or 4 o'clock position and/or in the 5 o'clock position, 6 o'clock position or 7 o'clock position and/or in the 8 o'clock position, 9 o'clock position or 10 o'clock position.

As FIG. 14 shows in an effective manner, the closure element (7) in the position pivoted to the side, opening the entry opening (5) of the cooking vapor entry device (2), may effect a lateral laminar alignment of the cooking vapors flowing through the cooking vapor entry device (2), in the direction of the longitudinal axis (8) of the preliminary section (9) of the exhaust air duct (3) connected from below at an angle to the cooking vapor entry device (2).

The pivotable or rotatable or foldable closure element (7) for closing the entry opening (5) of the cooking vapor entry device (2) may, in cross section, be straight in a plate-shaped manner or, for example, curved in a concave manner in its closing region.

Thus the radius of curvature for a concave curvature of the curved plate-shaped closure element (7) may be, for example, in the range of 20 mm to 150 mm, preferably in the range of 25 mm to 80 mm, in particular in the range of 30 mm to 60 mm.

Generally, therefore, the closure element (7) may be reversibly rotated or pivoted or folded from its closed position closing the entry opening (5) of the cooking vapor entry device (2) located in the 12 o'clock position relative to the pivot point (6), into an open position additionally rotated or pivoted by an angle β in one or the other direction.

In this connection, the angle β on both sides of an imaginary vertical line (12) marking the 12 o'clock position, through the pivot point (6) or the rotational axis, may be in the range of 30° to 70°, preferably in the range of 35° to 65°, in particular in the range of 40° to 60°.

Generally, the preliminary section (9) of the exhaust air duct (3) in cross section is connected to the cooking vapor entry device (2) from the left or the right in an oblique alignment and from below. In this connection, the open position of the rotatable or pivotable closure element (7), which is pivoted or rotated to the side for opening the entry opening (5) of the cooking vapor entry device (2) is preferably located in cross section on that side which opposes the side of the connection of the preliminary section (7) of the exhaust air duct (3) to the cooking vapor entry device (2).

Preferably, the passage of the cooking vapors flowing through the cooking vapor entry device (2) and the deflection thereof by means of the closure element (7) rotated or pivoted to the side, or instead thereof by means of the wall (4), which is oblique or curved in a concave manner, of the cooking vapor entry device (2), is free of turbulence and/or laminar in the obliquely connected preliminary section (9) of the exhaust air duct (3).

As in particular emerges from FIG. 11, in the case of the exhaust device according to the invention, the vertically upward facing entry opening (5) of the cooking vapor entry device (2) may be configured in plan view in the form, for example, of a rectangle, an oblong hole or a slot.

Also clearly visible from FIG. 11 is that the closure element (7) of the cooking vapor entry device (2) generally may be rotated or pivoted or folded about a rotational axis (6), which in plan view is approximately parallel to the longitudinal axis of the entry opening (5) and in plan view extends approximately centrally to the entry opening (5) and in cross section is located level with or just below the hob plane (1).

The closure element (7) may be reversibly rotated or pivoted or folded to and fro about the rotational axis (6), for example by means of a motor.

Alternatively thereto, the closure element (7) may be mechanically rotated or pivoted or folded about the rotational axis (6), for example by means of a rotary wheel (13), reversibly to and fro.

In particularly preferred embodiments of the cooking vapor exhaust device according to the invention, the rotational axis (6) may be configured in the form, for example, of a continuous rod which is substantially horizontally aligned.

Also in particularly preferred embodiments of the cooking vapor exhaust device according to the invention, the rotational axis (6) may be configured in the form, for example, of two approximately horizontally opposing suspension points for the rotatable or pivotable or foldable closure element (7), so that the drawn-in cooking vapor flow in its entire width may flow undivided without turbulence into the entry opening (5) and through said entry opening.

The closure element (7) may, in longitudinal section for example, have the shape of the letter U, the two free ends respectively being connected to the rotational axis (6) and the central horizontal portion extending horizontally over the length of the entry opening (5) of the cooking vapor entry device (2).

In particularly preferred embodiments of the cooking vapor exhaust device according to the invention, a single or multi-part overflow protection and/or mounting frame (14) may be provided fixedly or removably, peripherally or partially to the side outside the vertically upward facing entry opening (5) of the cooking vapor entry device (2). Generally, the edge region of the overflow protection facing the entry opening (5) and mounting frame (14) are at least slightly raised vertically relative to the hob plane (1) for providing protection against boiling over.

Generally, the cooking vapor exhaust device according to the invention is sealed substantially flush, both in the open operating state and in the closed state, with the surface of the hob plane (1) and/or with the surface of the worksurface receiving said hob plane.

The substantially flush seal with the surface of the hob leads to the significant advantage that in the case of the cooking vapor exhaust device according to the invention, the restriction of the handling room in the region of the hob which is regarded as particularly disadvantageous in exhaust devices of the prior art, is reliably prevented by exhaust device components projecting vertically and/or horizontally over the hob even in the operating state.

Alternatively thereto, merely the mounting frame and overflow protection (14) may project over the surface of the hob plane (1) or the surface of the worksurface receiving said hob plane, in the range of 0.5 mm to 5.0 mm, preferably in the range of 1.0 mm to 4.0 mm, in particular in the range of 1.5 mm to 3.0 mm.

In particularly preferred embodiments of the cooking vapor exhaust device, the closure element (7) with or without its counter weight (15) as well as with or without a rotary wheel (13) may be easily, simply, effortlessly and rapidly removed from the cooking vapor entry device (2) for the manual rotation or pivoting of the closure element (7) about its rotational axis (6) without tools for cleaning purposes.

Due to this feature of a particularly easy and rapid removability, if required the closure element (7) with the counter weight (15) and rotary wheel (13) may be easily moved to a dishwasher for frequent cleaning processes.

Generally, the dimensions of the closure element (7), its counter weight (15) and its manually drivable rotary wheel (13) and the spatial association thereof to one another are selected so that a rapid, simple and effortless removability of the closure element (7), the counter weight (15) and the rotary wheel (13) from the cooking vapor entry device (2) is possible without previously removing the mounting frame and overflow protection (14).

Generally, in the case of the cooking vapor exhaust device according to the invention, the spacing between the cooking vapor entry device (2), on the one hand, and the fan motor(s), on the other hand, may be in the range of 0.5 mm to 100 m preferably in the range of 1 m to 80 m, in particular in the range of 1.5 m to 15 m.

In particular, due to the low flow resistance caused by the laminar, turbulence-free deflection, in the case of the cooking vapor exhaust device according to the invention, for the first time it is possible to provide the fan motor at such a large distance from a cooking vapor entry device (2). The fan motor may, therefore, easily be positioned outside the kitchen unit receiving the cooking vapor exhaust device according to the invention, for example in the cellar or in the loft of a house.

In an alternative embodiment, in a cross sectional view the pivot axis (6) of the closure element (7) may be vertically level approximately with the upper face of the hob plane (1) and horizontally may be in the lateral edge region of the entry opening (5) of the cooking vapor entry device (2).

In this case, when actuating the fan motor the closure element (7) may turn away automatically downward, opening the entry opening (5). After switching off the fan motor, due to a spring action the downwardly folded closure element (7) may again pivot back upward into its position closing the entry opening (5).

Generally, the rotational axis (6), in this case horizontally, is in said lateral edge region of the entry opening (5) which in cross section opposes the side of the connection of the preliminary section (7) of the exhaust air duct (3) to the cooking vapor entry device (2).

Thus according to FIG. 18 in a cross-sectional view the pivot axis (6) of the closure element (7) may be vertically approximately level with the upper face of the hob plane (1) and horizontally may be in the lateral edge region of the entry opening (5) of the cooking vapor entry device (2), so that when actuating a fan motor the closure element (7) automatically turns away downward, opening the entry opening (5) and after switching off the fan motor due to a spring action again pivots back into the position closing the entry opening (5) upward into the initial horizontal position.

According to FIG. 19, in a cross-sectional view two opposing pivot axes (6) of two closure elements (7) horizontally aligned in the closed state and tightly abutting one another or at least slightly overlapping and opposing one another in the manner of a hinged door, are located vertically approximately level with the upper face of the hob plane (1) and horizontally are located in the two lateral longitudinal edge regions of the entry opening (5) of the cooking vapor entry device (2).

In this case, the two closure elements (7) opposing one another in the manner of a hinged door, when actuating a fan motor, pivot away downward automatically, opening the entry opening (5), and after switching off the fan motor due a spring action again pivot back into their initial position closing the entry opening (5), upward into the initial horizontal position.

As FIG. 18 shows, the rotational axis (6) horizontally may be located in the lateral edge region of the entry opening (5) which in cross section opposes the side of the connection of the preliminary section (9) of the exhaust air duct (3) to the cooking vapor entry device (2).

Also, in a particularly preferred embodiment of the device according to the invention, the cooking vapor entry device (2) and the preliminary section (9) of the exhaust air duct (3) and the connecting section (10) of the exhaust air duct (3) merge with one another in cross section in a manner which is without steps, transitions, edges, buckling and which is continuous for ensuring a laminar, turbulence-free conveyance of the drawn-in cooking vapors or are configured integrally.

As emerges from FIG. 20, in the region of the downstream exit opening (25) of the connecting section (10) of the exhaust air duct (3), one or more filter elements (35) are preferably provided in a reversible manner located obliquely to the flow direction of the drawn-in cooking vapors and/or to the vertical.

The filter element(s) (35) may, for example, be a wire mesh filter or a filter made of synthetic non-woven fabric.

Preferably, the through-flow surface of the filter element (35) is greater than the surface of the entry opening (5) of the cooking vapor entry device (2).

As a result of the ratio of these two surfaces to one another, the cooking vapor flow velocity in the region of the filter element may be set to an optimum value relative to the filter action, namely the most effective fat smoke removal of each filter element (35) at a quite specific flow velocity dependent on the filter material.

In particularly preferred embodiments of the device according to the invention for drawing in cooking vapors, the edge region (37) of the filter element (35) located vertically underneath, for example, may be incorporated in a groove-shaped bulged portion (36) of the preliminary section (9) of the exhaust duct (3) or of the connecting section (10) of the exhaust air duct (3) (see FIG. 20).

This bulged portion (36) results, amongst other things, in the advantage that fluids running away from the filter element (35) or penetrating through the entry opening (5) of the cooking vapor entry device (2) collect therein and are reliably prevented thereby from flowing away in the downstream direction which would cause soiling and, moreover, may be easily collected and removed therefrom.

Generally, the frame edge regions (37) of the filter elements (35) are located outside the flow cross section of the exit opening (25) of the connecting section (10) of the exhaust air duct (3).

Preferably, the cooking vapor through-surface of the filter element (35) is at a ratio to the surface of the entry opening (5) of the cooking vapor entry device (2) of 2.0 to 1.2, preferably in the range of 1.8 to 1.3, in particular in the range of 1.7 to 1.4 to 1.

In this case, the flow velocity of the cooking vapors in the region of the filter element (35) may be in the range of 3.0 m/sec to 1.5 m/sec, preferably in the range of 2.5 m/sec to 1.6 m/sec, in particular in the range of 2.0 m/sec to 1.7 m/sec.

In summary, it has to be stressed that within the scope of the present invention a kitchen exhaust device is provided which, in spite of a removal of the cooking vapors vertically below the hob plane (1) the interior of the kitchen unit receiving the exhaust device according to the invention is substantially unobstructed vertically and, therefore, usable for drawers, built-in items or storage purposes.

A further significant advantage of the cooking vapor exhaust device according to the invention, in particular, is due to the flat exhaust duct thereof configured according to the invention, that the in-system flow resistances of the cooking vapor exhaust device according to the invention and the flat exhaust air duct elements aligned according to the invention are particularly small and therefore the advantageous use of particularly small fans is possible with particularly low power consumption and noise development—in comparison with the powerful fans used in cooking vapor exhaust devices of the prior art.

The invention claimed is:

1. A device which is mounted in a cooking base unit for removing cooking vapors from above a horizontal hob plane of the cooking base unit along a horizontal exhaust path immediately below the hob plane, where a flow of the cooking vapors through the device is laminar, said device comprising:

a cooking vapor entry device including an entry opening which is horizontally disposed in the hob plane, which is vertically upward facing, and which has a horizontal width and length defining a horizontal longitudinal axis, and a closed side wall depending downwardly from said entry opening and defining a vertically downward vapor flow path from the entry opening to immediately below the hob plane;

an exhaust air duct system fluidly connected to an end of the closed side wall of the cooking vapor entry device and extending horizontally away therefrom immediately below and parallel to the hob plane, said horizontal exhaust air duct system including a connecting section immediately downstream on the cooking vapor entry device which smoothly transitions the vertically downward vapor flow path of the closed side wall to a horizontal vapor flow path immediately below the hob plane, said connecting section including a downstream exit opening which is vertically disposed and having a vertically extending cross section, where a horizontal width of said exit opening is larger than a vertical height thereof and the horizontal width of said exit opening corresponds approximately to the width of said entry opening of the cooking vapor entry device, at least one flat duct element being fluidly connected to the connecting section downstream of the exit opening thereof, defining a horizontal vapor flow path immediately below and parallel to the hob plane and extending from the downstream exit opening of the connecting section to a vertically disposed downstream exit of the at least one flat duct element at a side of the cooking base unit, and being defined by a continuous series of vertically disposed, rectangular cross-sections transverse to the horizontal vapor flow path, a closure element which controls the passage of the cooking vapors flowing through the cooking vapor entry device so that the cooking vapor entry device can be reversibly opened and closed to vapor flow, said closure element a) being located at all times in the cooking vapor entry device immediately below the entry opening thereof, and b) having a rotational axis by which the closure element is rotated between a closed position blocking the entry opening to vapor flow and an open position on one side of the longitudinal axis of the entry opening not obstructing vapor flow through the entry opening, where the rotational axis of the closure device is i) located in a vertical plane including the longitudinal axis, ii) below the longitudinal axis, iii) parallel to the longitudinal axis and iv) not above the hob plane, c) being located, due to the location of the rotational axis, in the closed position approximately parallel and immediately adjacent to the longitudinal axis of the entry opening and extending approximately centrally from the longitudinal axis to close the entry opening, and d) being located, due to the location of the rotational axis, in the open or closed position no higher than the entry opening; and a rotary wheel operatively connected to the closure element which is manually rotated to drive the closure element about the rotational axis thereof between the open and closed positions.

2. A kitchen exhaust device system comprising:

a kitchen base unit having a work surface and a hob defining a hob plane; and a device for removing cooking vapors in a horizontal flow direction, said device being located in said base unit vertically at and immediately below the hob plane, and extending horizontally towards a side of the base unit, and where a flow of the cooking vapors through the device is laminar, the device comprising a cooking vapor entry device including an entry opening which is horizontally disposed in the hob plane, which is vertically upward facing, and which has a horizontal width and length defining a horizontal longitudinal axis, and a closed side wall depending downwardly from said entry opening and defining a vertically downward vapor flow path from the entry opening to immediately below the hob plane;

an exhaust air duct system fluidly connected to an end of the closed side wall of the cooking vapor entry device and extending horizontally away therefrom immediately below and parallel to the hob plane, said horizontal exhaust air duct system including a connecting section immediately downstream on the cooking vapor entry device which smoothly transitions the vertically downward vapor flow path of the closed side wall to a horizontal vapor flow path immediately below the hob plane, said connecting section including a downstream exit opening which is vertically disposed and having a vertically extending cross section, where a horizontal width of said exit opening is larger than a vertical height thereof and the horizontal width of said exit opening corresponds approximately to the width of said entry opening of the cooking vapor entry device, at least one flat duct element being fluidly connected to the connecting section downstream of the exit opening thereof, defining a horizontal vapor flow path immediately below and parallel to the hob plane and extending from the downstream exit opening of the connecting section to a vertically disposed downstream exit of the at least one flat duct element at a side of the cooking base unit, and being defined by a continuous series of vertically disposed, rectangular cross-sections transverse to the horizontal vapor flow path, a closure element which controls the passage of the cooking vapors flowing through the cooking vapor entry device so that the cooking vapor entry device can be reversibly opened and closed to vapor flow, said closure element a) being located at all times in the cooking vapor entry device immediately below the entry opening thereof, and b) having a rotational axis by which the closure element is rotated between a closed position blocking the entry opening to vapor flow and an open position on one side of the longitudinal axis of the entry opening not obstructing vapor flow through the entry opening, where the rotational axis of the closure device is i) located in a vertical plane including the longitudinal axis, ii) below the longitudinal axis, iii) parallel to the longitudinal axis and iv) not above the hob plane, c) being located, due to the location of the rotational axis, in the closed position approximately parallel and immediately adjacent to the longitudinal axis of the entry opening and extending approximately centrally from the longitudinal axis to close the entry opening, and d) being located, due to the location of the rotational axis, in the open or closed position no higher than the entry opening, and a rotary wheel operatively connected to the closure element which is manually rotated to drive the closure element about the rotational axis thereof between the open and closed positions, wherein a vertical spacing between a) the entry opening of the cooking vapor entry device which is located at a vertical height of the hob plane and b) a lower side of the downstream of a first one of said at least one flat duct elements, which is configured in the form of a 90° horizontal bend, is in the range of 20.0 cm to 10.0 cm, so that a space of the kitchen base unit below the device for removing cooking vapors and below the at least one flat duct element leading away downstream therefrom is useful without any spatial restriction caused by the cooking vapor entry device.

3. The device as claimed in claim 1, further including a fan adapted to draw the cooking vapors in over the entire width of the entry opening of the cooking vapor entry device in a manner which is without turbulence and laminar and with low resistance in the at least one flat duct element.

4. The device as claimed in claim 1, wherein the vertically upward facing entry opening of the cooking vapor entry device is configured in plan view in the form of one of a rectangle, an oblong hole or a slot.

5. The device as claimed in claim 1, wherein the rotational axis of the closure element is defined by one of a continuous rod which is substantially horizontally aligned or two approximately horizontally opposing suspension points.

6. The device as claimed in claim 1, wherein the closure element in longitudinal section has the shape of the letter U, wherein the two longitudinal free ends of the closure element are respectively connected to the rotational axis, and wherein, when the closure element is in the closed position, the central horizontal portion of the closure element extends horizontally over the length of the entry opening of the cooking vapor entry device.

7. The device as claimed in claim 1, further including an overflow protection and mounting frame is provided to the outside of the vertically upward facing entry opening of the cooking vapor entry device, said frame having an edge region facing the entry opening which is at least slightly raised vertically relative to the hob plane for providing protection against boiling over liquids which land on the hob plane.

8. The device as claimed in claim 1, further including a filter element provided non-horizontally in the region of the downstream exit opening of the connecting section of the exhaust air duct obliquely to the flow direction of the drawn-in cooking vapors, the edge regions of the filter element being located outside the flow cross section of the exit opening of the connecting section of the exhaust air duct and including a vertically lowermost edge region; and a groove-shaped bulged portion provided in the connecting section underneath the cooking vapor entry device in which the lowermost edge region of the filter element is located and in which fluids accumulate.

9. The device as claimed in claim 1, wherein the connecting section includes a downstream section which extends horizontally away from the cooking vapor entry device, and an upstream preliminary section which transitions the cooking vapor flow smoothly from the vertical closed side wall of the cooking vapor entry device to the horizontal downstream section.

10. The device as claimed in claim 9, wherein the upstream preliminary section includes an inner wall which is oblique to the direction of fluid flow in the cooking vapor entry device and to the direction of flow in the downstream section.

11. The device as claimed in claim 9, wherein the upstream preliminary section includes an inner wall which is curved to lead the fluid flow in the cooking vapor entry device smoothly into the downstream section.

12. The device as claimed in claim 1, wherein the closure element is part of a closure device which includes a counter weight attached opposite to the closure element.

13. The device as claimed in claim 1, wherein the at least one flat duct element has a vertically disposed downstream exit opening at the side of the cooking base unit whose vertical cross section is rectangular and approximately the same as the vertical cross section of the downstream exit opening of the connection section.

14. The device as claimed in claim 1, wherein the rotary wheel is housed in the cooking vapor entry device with only a portion of the wheel extending upwards beyond the cooking vapor entry device for manual rotation thereof to drive the closure element.

* * * * *